US011717742B2

(12) United States Patent
Turner et al.

(10) Patent No.: US 11,717,742 B2
(45) Date of Patent: Aug. 8, 2023

(54) FOOTPAD WITH SENSOR COMPATIBILITY

(71) Applicant: Carvewell LLC, Weaverville, NC (US)

(72) Inventors: Jonathan Daniel Turner, Asheville, NC (US); Justyn Douglas Thompson, Weaverville, NC (US)

(73) Assignee: Carvewell LLC, Weaverville, NC (US)

( * ) Notice: Subject to any disclaimer, the term of this patent is extended or adjusted under 35 U.S.C. 154(b) by 430 days.

(21) Appl. No.: 16/813,570

(22) Filed: Mar. 9, 2020

(65) Prior Publication Data

US 2020/0282293 A1 Sep. 10, 2020

Related U.S. Application Data

(60) Provisional application No. 62/815,285, filed on Mar. 7, 2019.

(51) Int. Cl.
*A63C 17/00* (2006.01)

(52) U.S. Cl.
CPC ..... *A63C 17/0006* (2013.01)

(58) Field of Classification Search
CPC ..... A63C 17/0006; A63C 17/12; A63C 17/08; B62K 11/007
See application file for complete search history.

(56) References Cited

U.S. PATENT DOCUMENTS 5,766,051 A * 6/1998 Messer ..... B63B 32/40 441/74
D746,928 S 1/2016 Doerkson
9,962,597 B2 * 5/2018 Doerksen ..... B62K 25/00
10,399,457 B2 * 9/2019 Doerksen ..... B62K 11/007
10,456,658 B1 * 10/2019 Doerksen ..... A63C 17/016
10,625,830 B2 * 4/2020 Lenchner ..... B63B 32/70
11,045,712 B1 * 6/2021 Orehek ..... A63C 17/12
2016/0121198 A1 5/2016 Doerkson et al.
2016/0136508 A1 * 5/2016 Bigler ..... B62K 15/00 180/181
2018/0169506 A1 * 6/2018 Ma ..... A63C 17/22

FOREIGN PATENT DOCUMENTS

WO 2016054690 A1 4/2016

OTHER PUBLICATIONS

"Cobra Extreme Performance Foot pad for Onewheel(tm)," eBay Website, Available Online at https://www.ebay.com/c/11025811178#viTabs_0, Available as Early as Feb. 14, 2019, 4 pages.

"OG Kush (V1, Plus, +XR," Float Supply Website, Available Online at https://float-supply.com/product/float-kush-concave-carvepower-x-float-life-collab/, Available as Early as Feb. 14, 2019, 7 pages.

* cited by examiner

*Primary Examiner* — Brian L Swenson
(74) *Attorney, Agent, or Firm* — McCoy Russell LLP

(57) ABSTRACT

Methods and systems are provided for concave footpads for a personal transport device. In one example, the concave footpads may be coupled to the personal transport device, arranged between an operator's feet and an upper surface of the personal transport device, the upper surface including a pressure transducer.

13 Claims, 20 Drawing Sheets

FOOTPAD WITH SENSOR COMPATIBILITY

CROSS REFERENCE TO RELATED APPLICATIONS

The present application claims priority to U.S. Provisional Application No. 62/815,285, entitled "FOOTPAD WITH SENSOR COMPATIBILITY", and filed on Mar. 7, 2019. The entire contents of the above-listed application are hereby incorporated by reference for all purposes.

FIELD

The present description relates generally to a footpad for a personal transport device.

BACKGROUND AND SUMMARY

Mobile boards used as personal transport devices have evolved dramatically. A variety of options for board shapes, materials, dimensions, and accessories have broadened the range of personal transport device applications and customizability. In recent years, motorized skateboards, in particular, have become a desirable method of personal transportation. As an example, some motorized skateboards resemble traditional skateboards with wheels positioned below a deck of the skateboard, at least one wheel proximate to an end of the skateboard. The motorized skateboards may be adapted with a motor delivering power to the wheels as well as weight sensor controls and/or a handheld throttle for controlling speed.

Another example of a motorized skateboard may have, instead of wheels at each end of the skateboard, a single wheel positioned at a central region of the skateboard deck and protruding through the deck. The wheel may be similarly powered by an electric motor and a pressure sensor may be arranged in a front end of the skateboard deck. Thus movement of the motorized skateboard may be controlled by adjusting weight placed on a lead foot of an operator.

For enhanced control of a skateboard, it may be desirable to provide concavity in an upper surface of the deck. For example, by configuring a peripheral border of the deck to be thicker than a central region of the deck, the operator may experience greater responsiveness from the skateboard to minute adjustments in weight transfer communicated through the operator's feet. A geometry of the deck of the motorized skateboard, however, may not be readily adapted to include a concave curvature due to the incorporation of sensors within the deck. Alternatively, optional concave footpads may be added to an upper surface of the deck. However, the footpads may not transmit shifts in weight distribution from the operator's feet, rendering the weight/pressure sensor unresponsive and inhibiting speed and directional control of the motorized skateboard.

The inventors herein have recognized the issue described above and have provided an approach for enabling implementation of concavity in a surface of a personal transport device while maintaining effectiveness of a pressure sensor in the device. The issue may be addressed by a footpad including a concave upper face and a planar lower face, the lower face opposite of the upper face and configured to be coupled to a pressure sensing device, and a central region of the footpad forming a planar section of the lower face configured to be positioned directly above the pressure sensing device. In this way, an operator may obtain greater responsiveness from the personal transport device during maneuvering of the device without sacrificing sensor sensitivity that may otherwise degrade speed control.

As one example, a footpad may be molded from a flexible material with a concave shape. The footpad material may balance enough rigidity to resist permanent deformation from the operator's weight with sufficient pliability to transmit shifts in weight distribution within at least one of the operator's feet. The footpad may be manufactured in a low-cost manner that allows a geometry of the footpad to be readily customized. Thus the footpad may be retrofitted to a wide variety of personal transport devices while allowing the operator's riding experience to be optimizable.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1-13, 16, and 18A-24B are shown approximately to scale.

DETAILED DESCRIPTION

Figure 1:
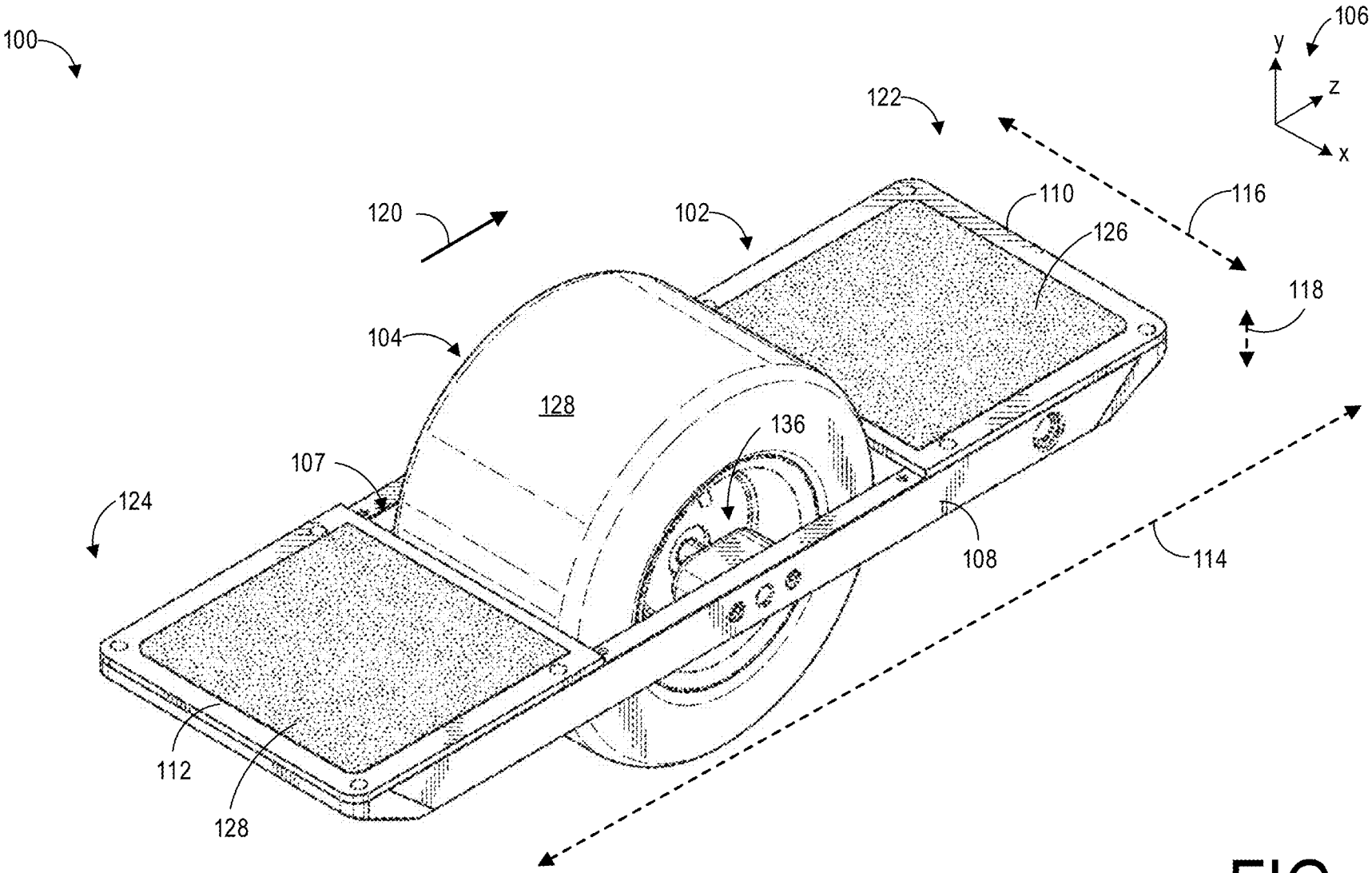
FIG. 1 shows an example of a motorized personal transport device adapted with at least one pressure sensor for controlling a speed of the personal transport device.
Figure 2:
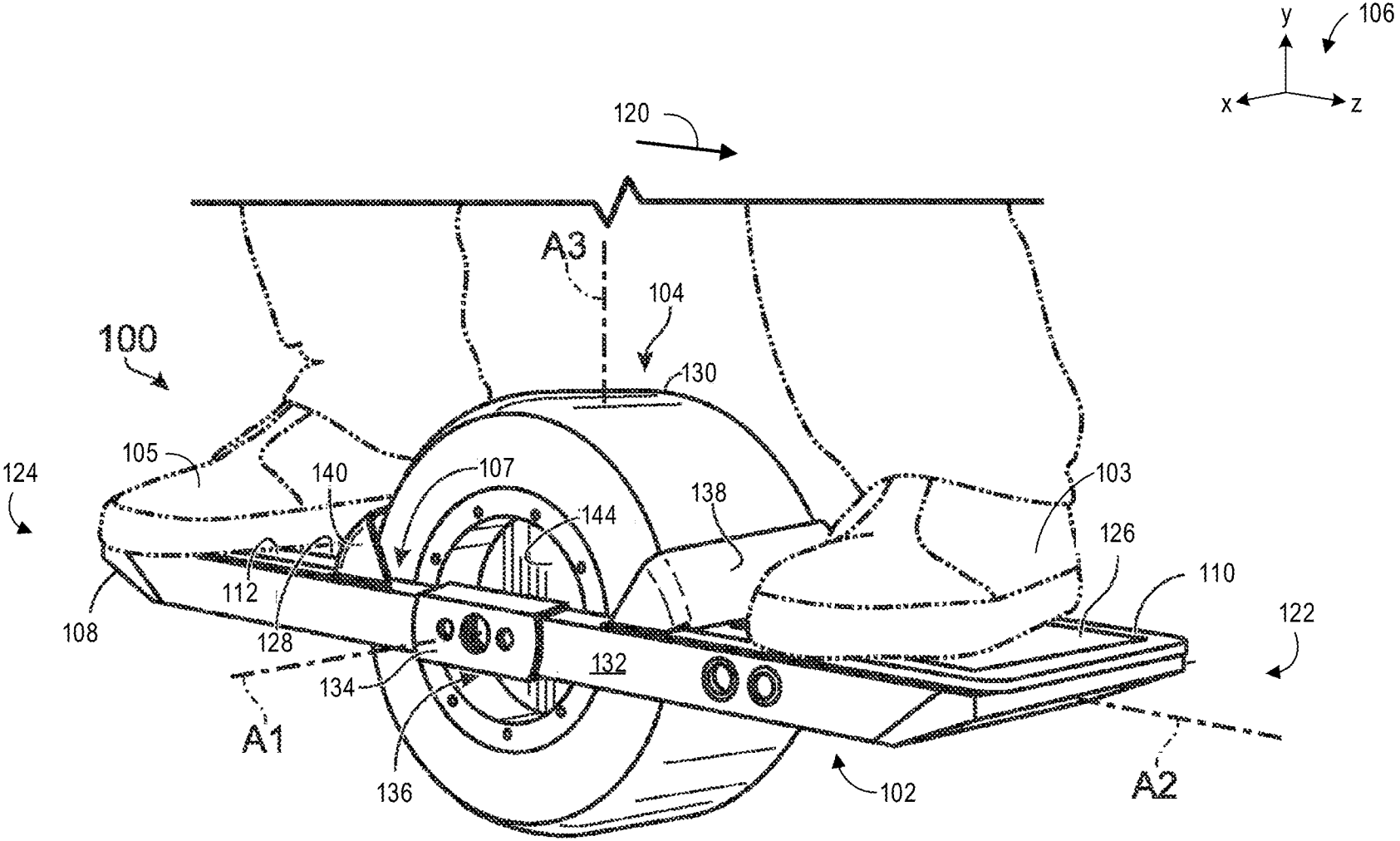
FIG. 2 shows an example of the motorized personal transport device with an operator positioned on the device.
Figure 3B:
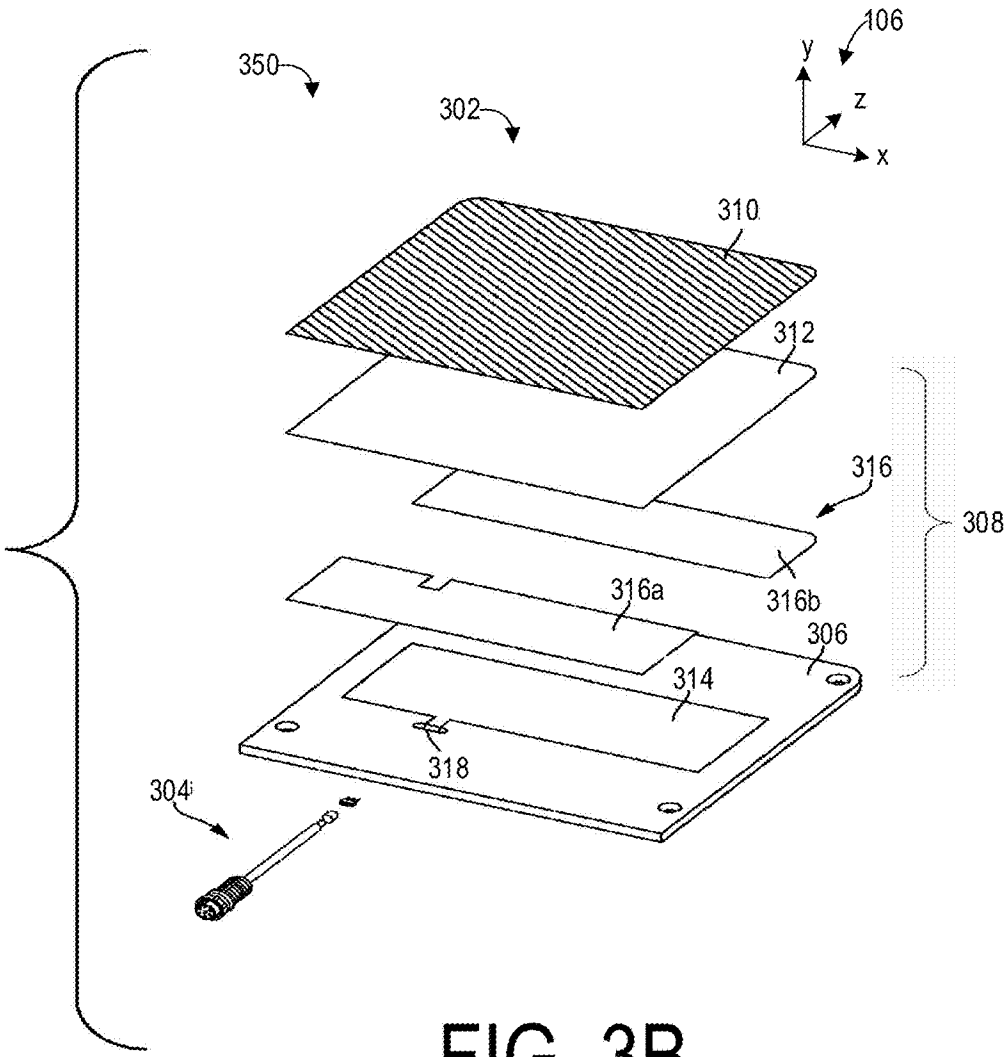
FIG. 3B shows an exploded view of the sensor assembly of FIG. 3A.
Figure 3A:
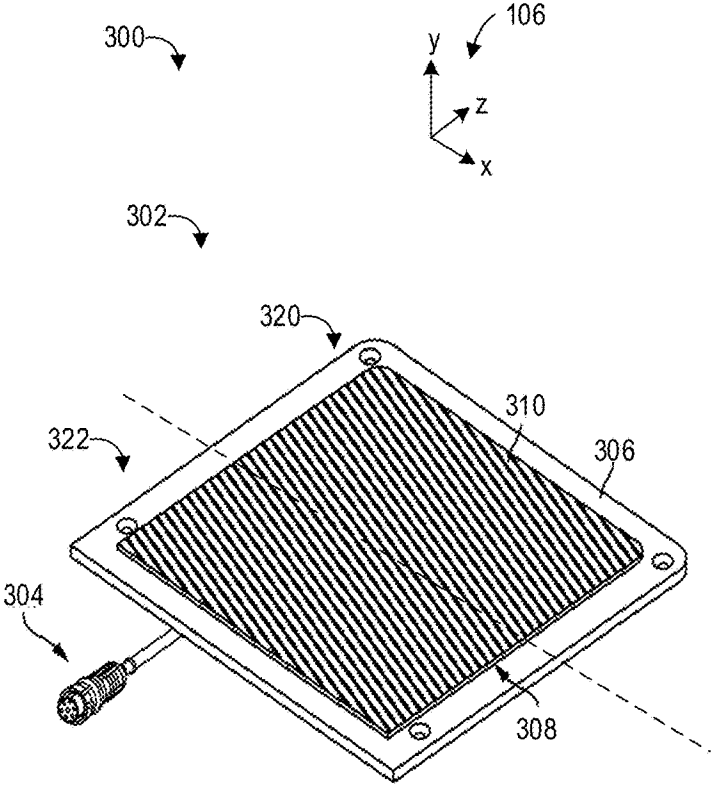
FIG. 3A shows an example of a sensor assembly that may be incorporated in the personal transport device.
Figure 9:
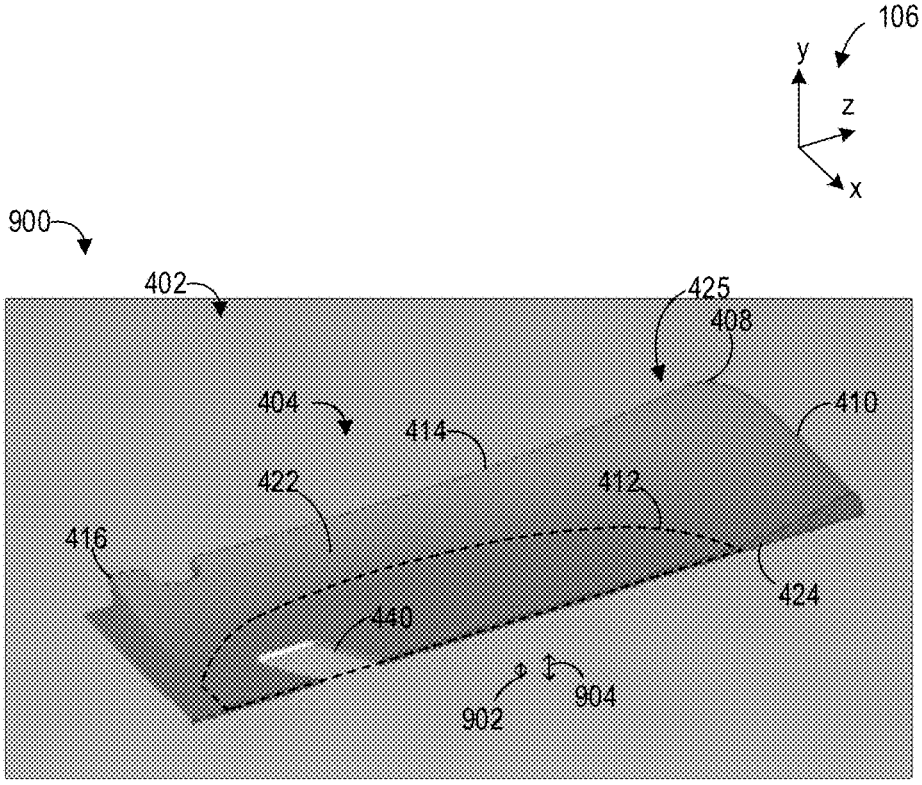
FIG. 9 shows a first cross-section of a footpad of the set of footpads.
Figure 10:
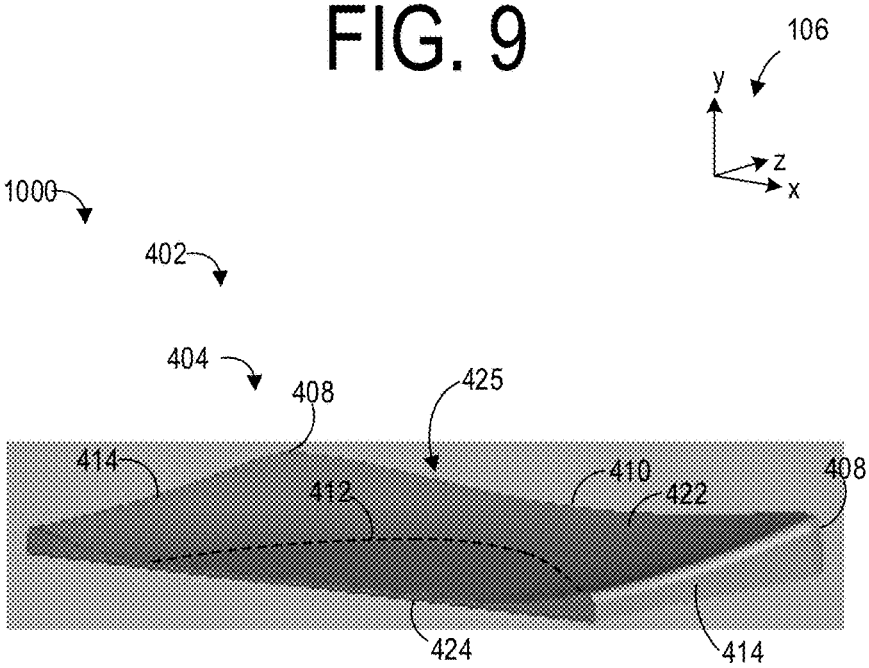
FIG. 10 shows a second cross-section of a footpad of the set of footpads.
Figure 13:
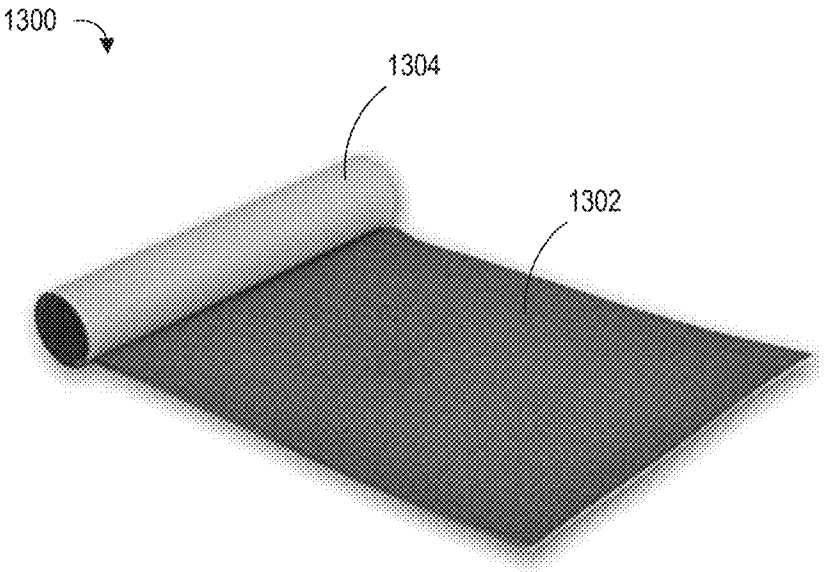
FIG. 13 shows an example of a textured layer that may be adhered to an upper surface of a set of footpads.
Figure 15:
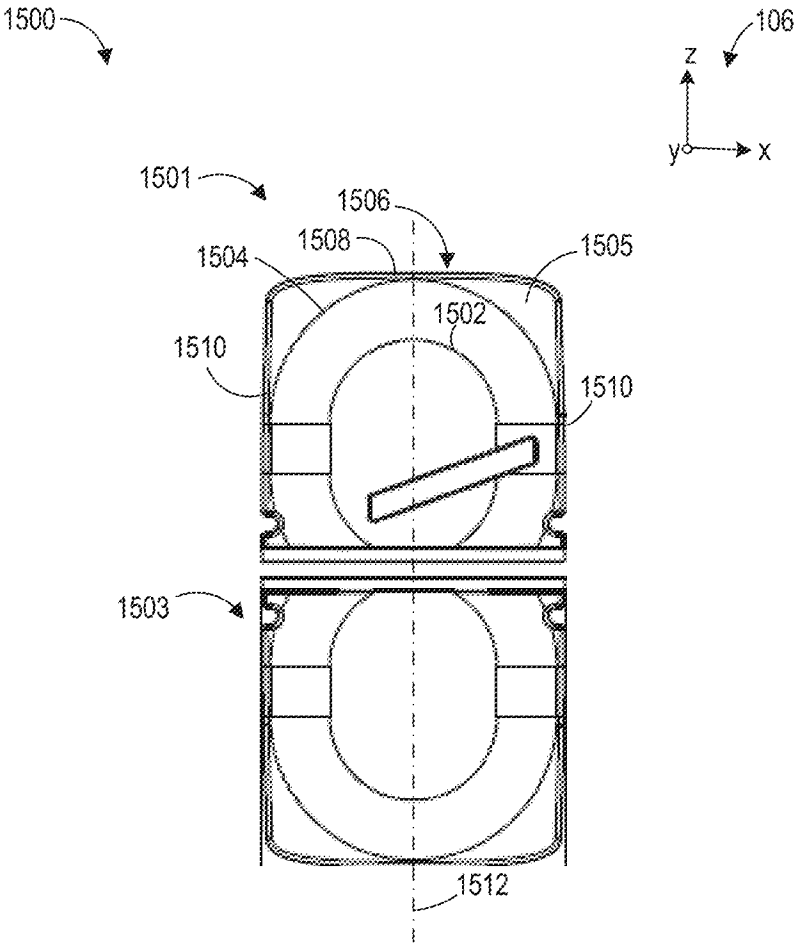
FIG. 15 shows a schematic diagram of a second footpad of a set of footpads with a second amount of curvature.
Figure 14:
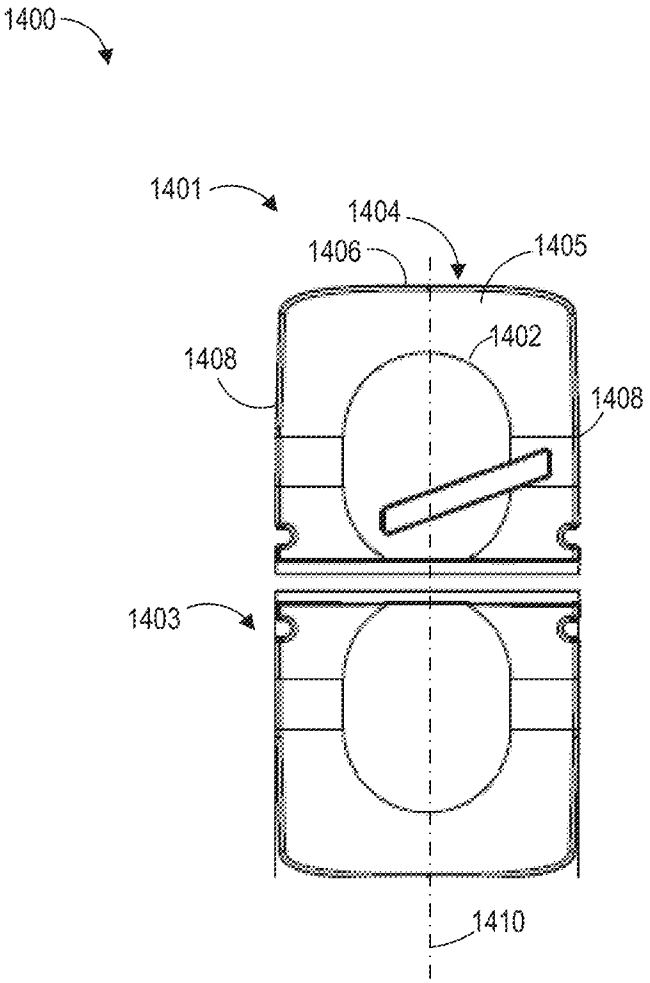
FIG. 14 shows a schematic diagram of a first footpad of a set of footpads with a first amount of curvature.
Figure 16:
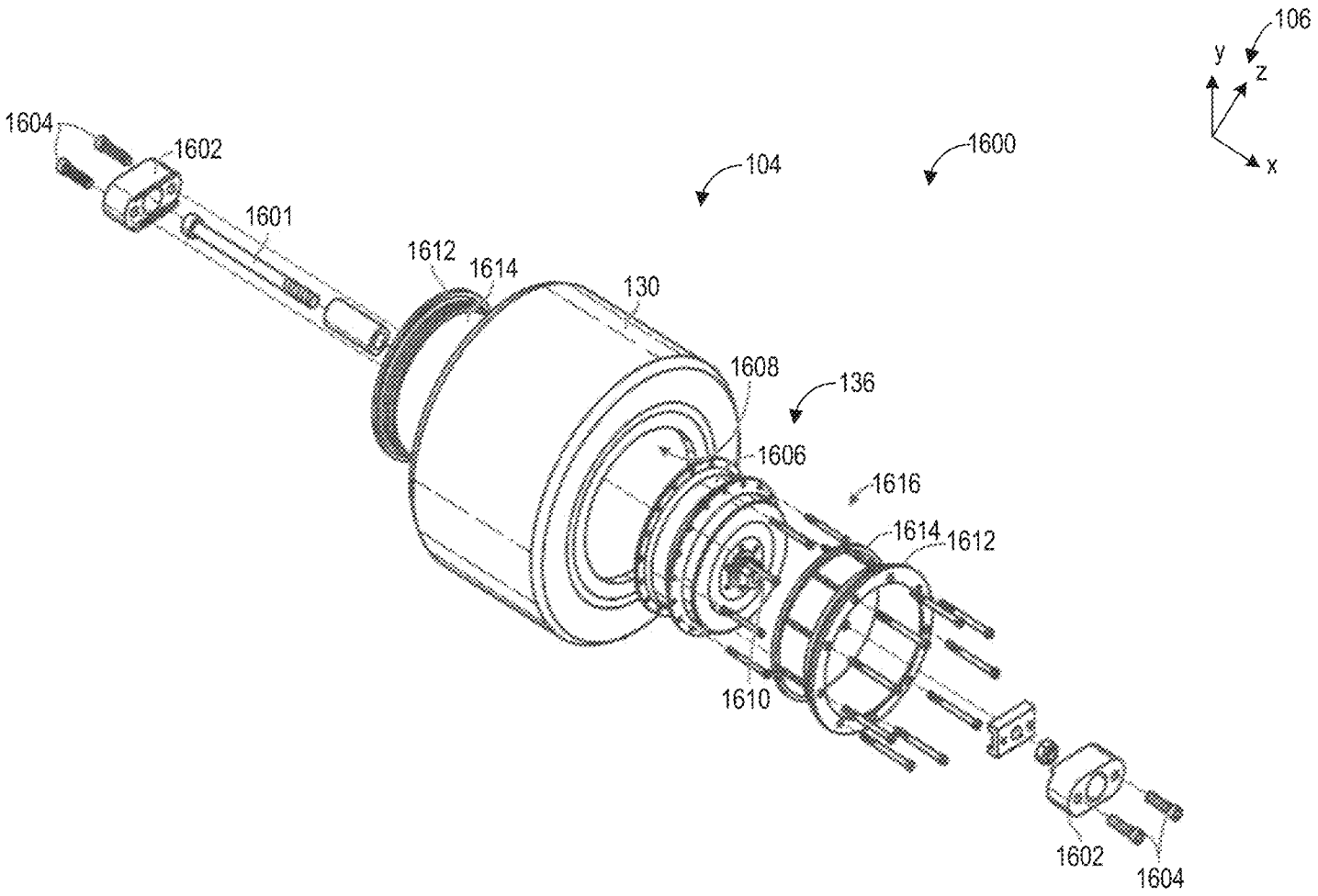
FIG. 16 shows an exploded view of a wheel assembly that may be included a personal transport device.
Figure 17:
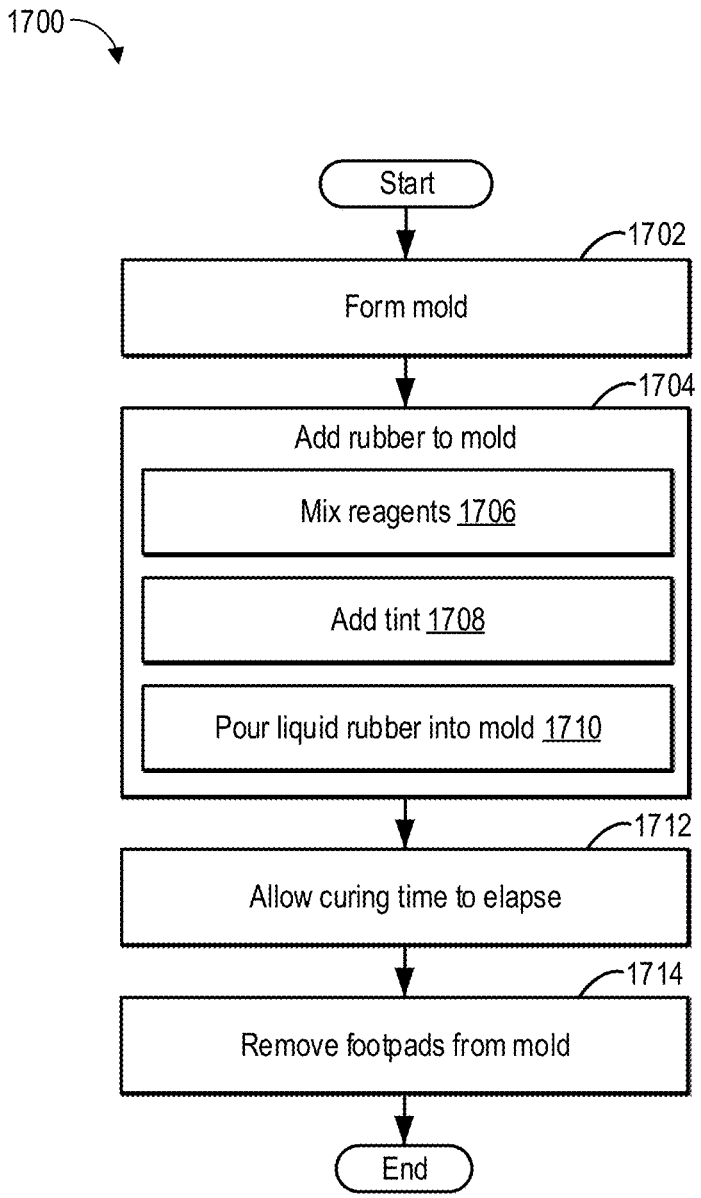
FIG. 17 shows an example of a method for manufacturing a set of footpads for a personal transport device.
Figure 18A:
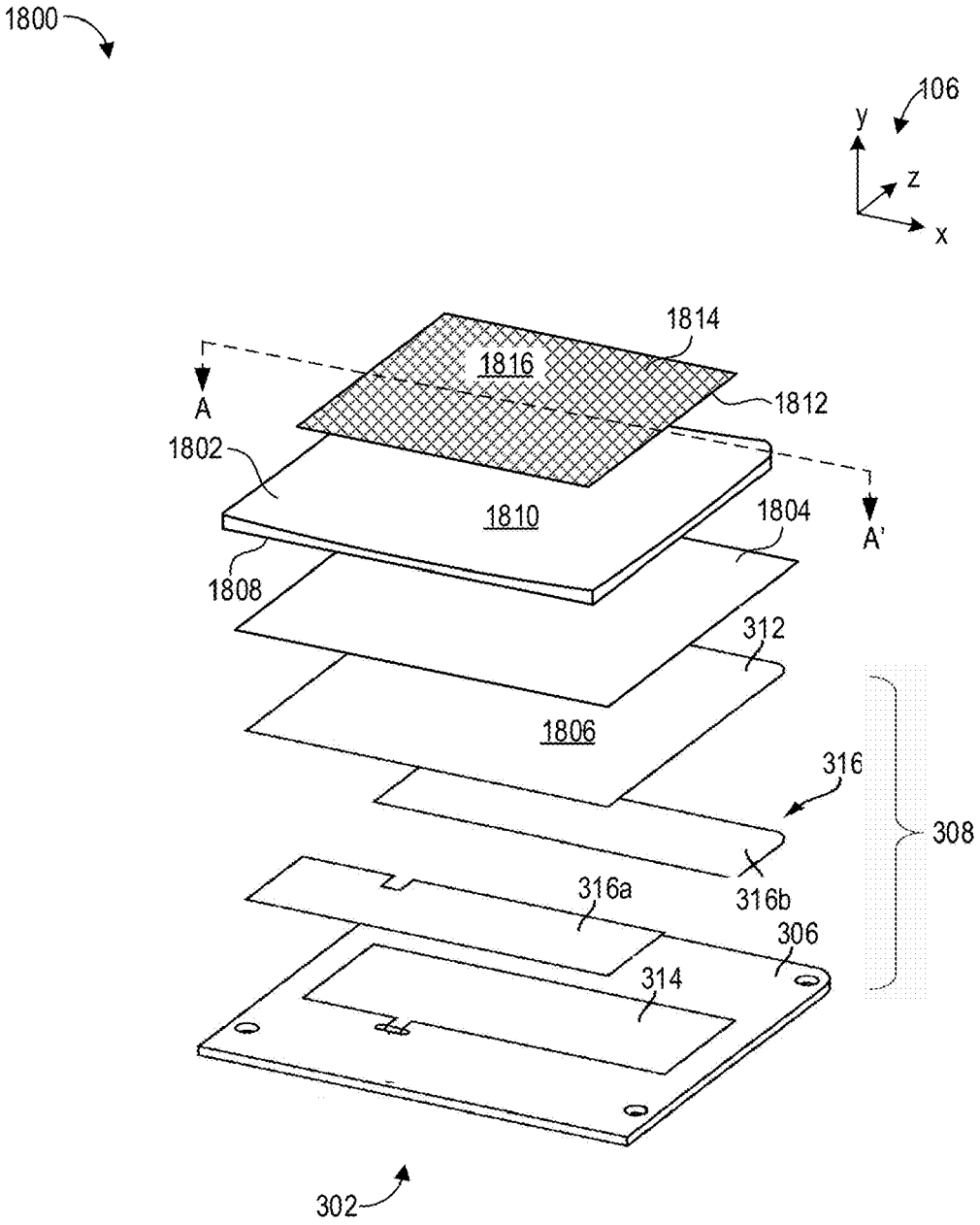
FIG. 18A shows an exploded view of a platform of a deck of a PT device configured with a rider detection device and a concave footpad.
Figure 18B:
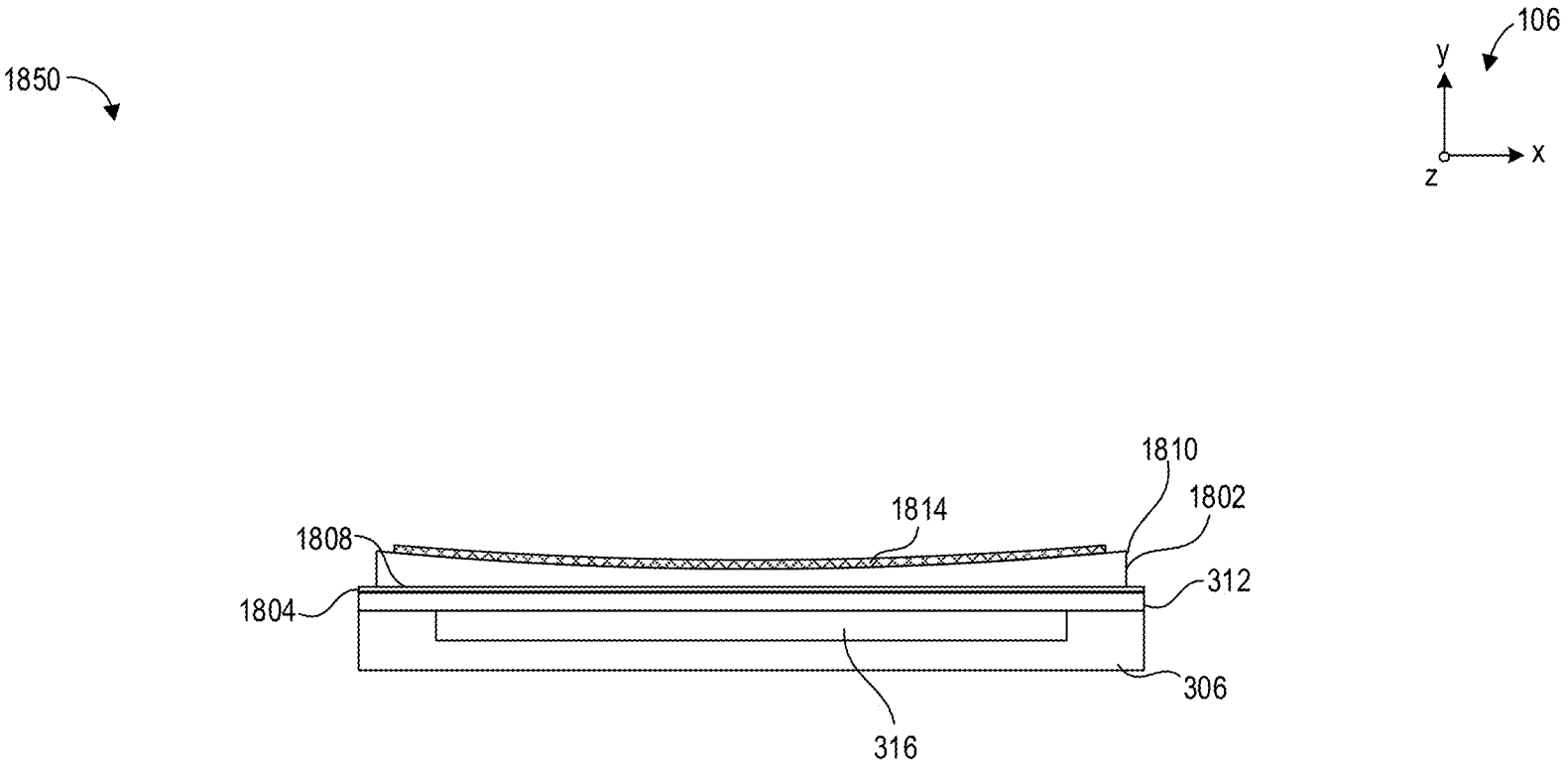
FIG. 18B shows a cross-section of the platform of FIG. 18A.
Figure 19B:
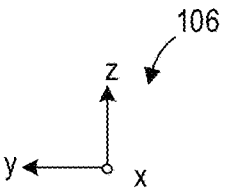
FIG. 19B shows the first alternative embodiment of the footpad from a profile view.
Figure 19B:
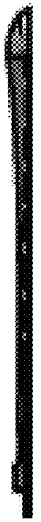
Figure 19A:
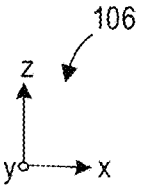
FIG. 19A shows a first alternative embodiment of a footpad from a birds-eye view.
Figure 19A:
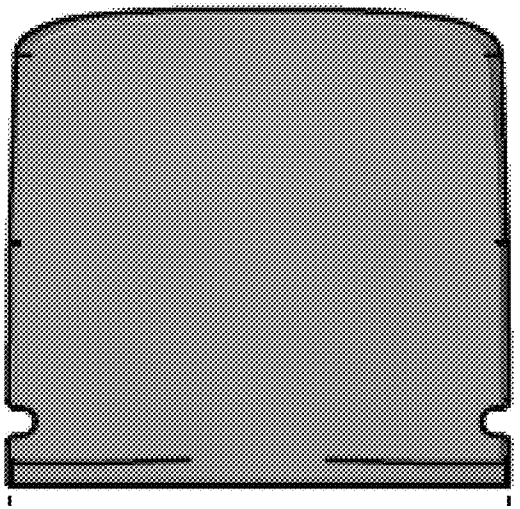
Figure 20B:
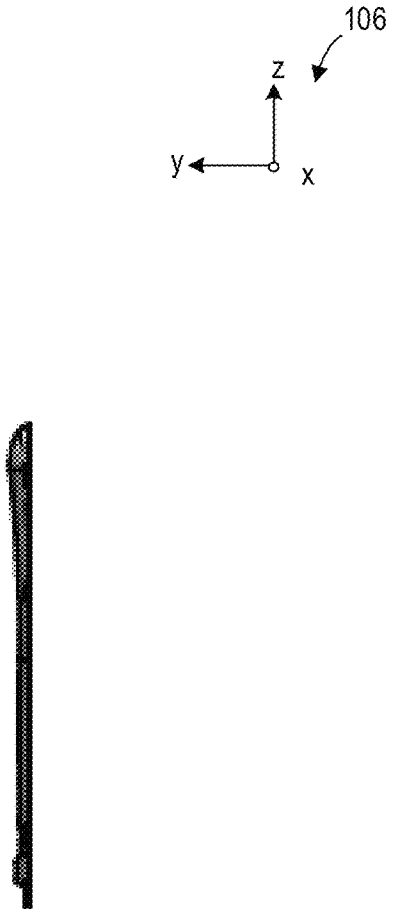
FIG. 20B shows the second alternative embodiment of the footpad from a profile view.
Figure 20A:
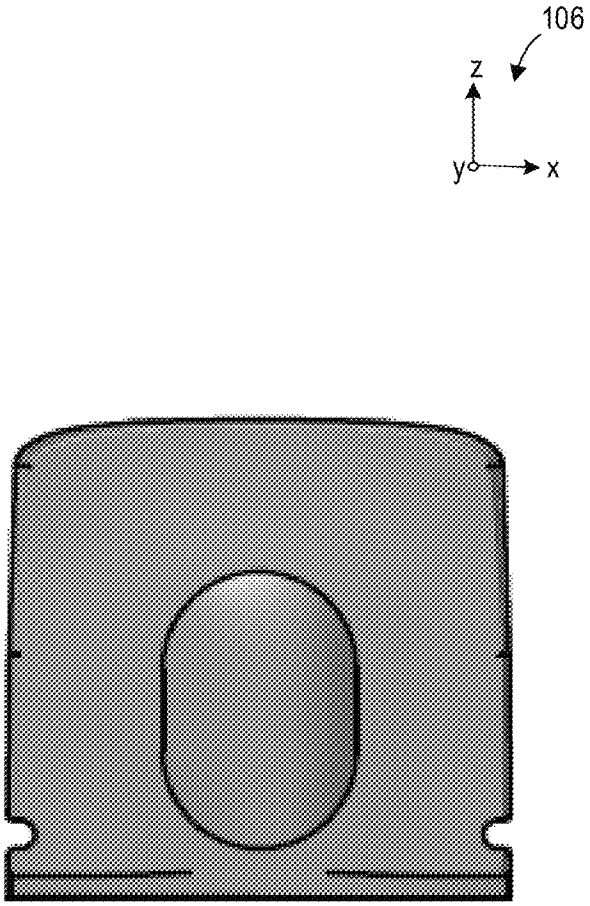
FIG. 20A shows a second alternative embodiment of a footpad from a birds-eye view.
Figure 21B:
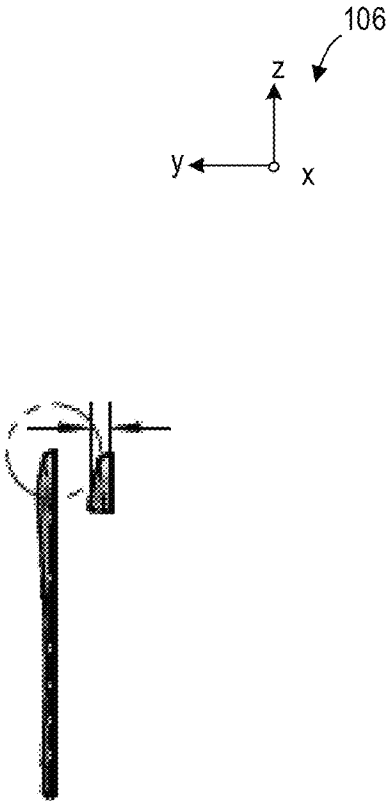
FIG. 21B shows the third alternative embodiment of the footpad from a profile view.
Figure 21A:
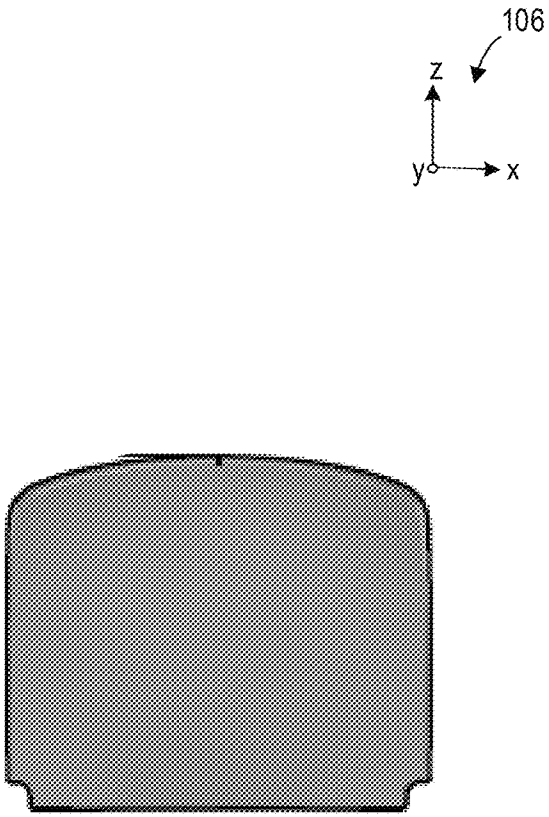
FIG. 21A shows a third alternative embodiment of a footpad from a birds-eye view.
Figure 22B:
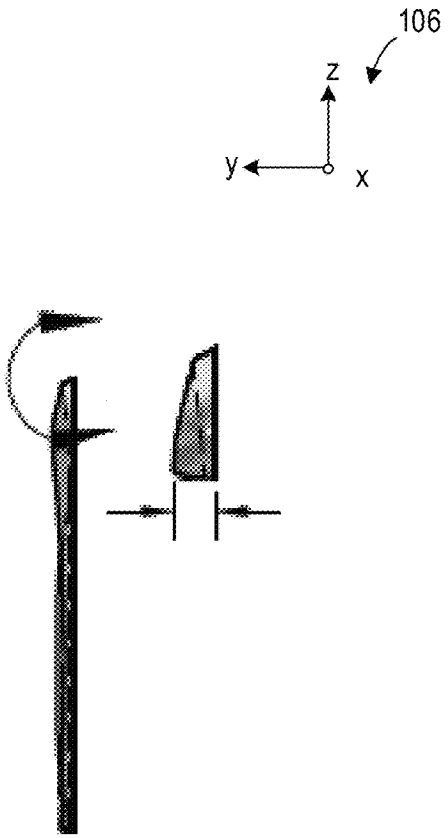
FIG. 22B shows the fourth alternative embodiment of the footpad from a profile view.
Figure 22A:
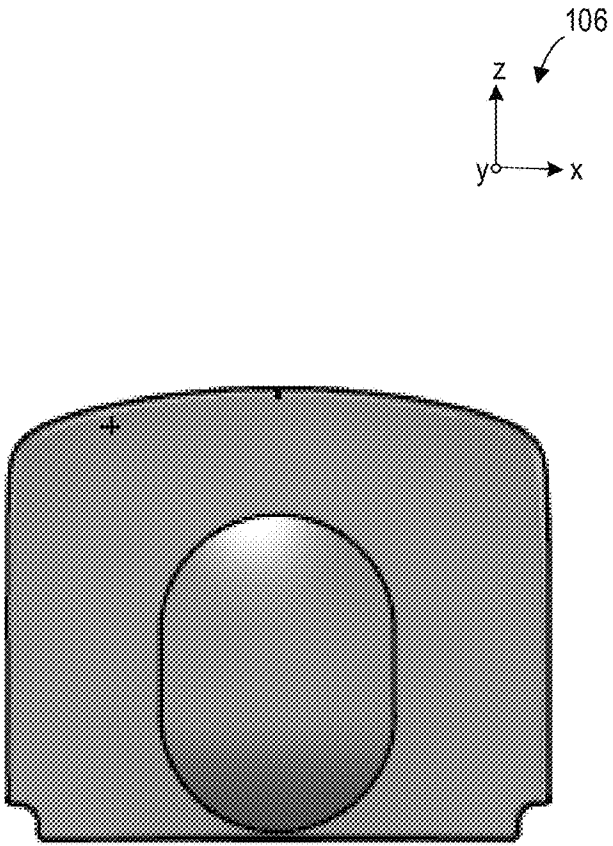
FIG. 22A shows a fourth alternative embodiment of a footpad from a birds-eye view.
Figure 23B:
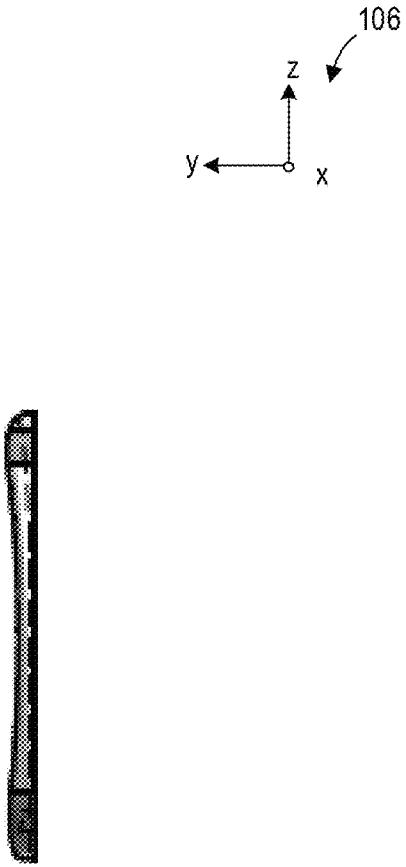
FIG. 23B shows the fifth alternative embodiment of the footpad from a profile view.
Figure 23A:
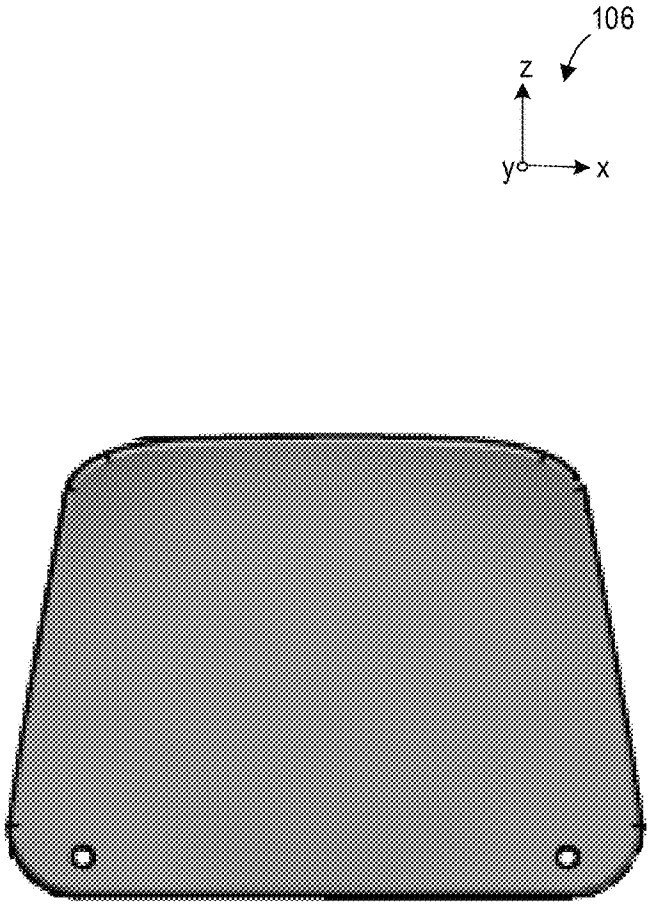
FIG. 23A shows a fifth alternative embodiment of a footpad from a birds-eye view.
Figure 24B:
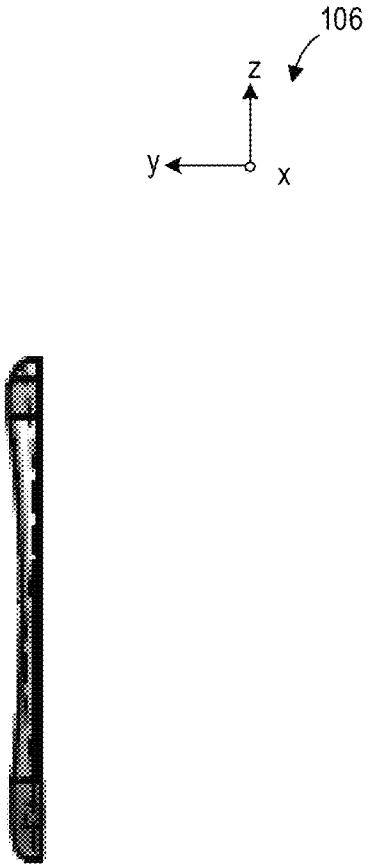
FIG. 24B shows the sixth alternative embodiment of the footpad from a profile view.
Figure 24A:
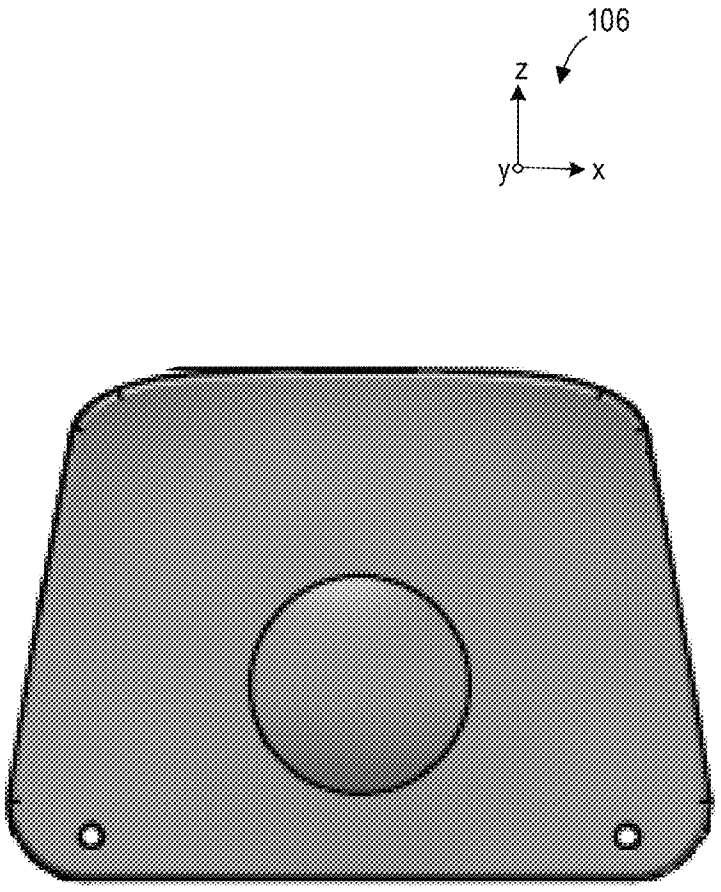
FIG. 24A shows a sixth alternative embodiment of a footpad from a birds-eye view.

The following description relates to systems and methods for a personal transport device. The personal transport device may be a motorized skateboard, as shown in FIG. 1. The motorized skateboard may have a deck and a wheel disposed in a central region of the deck. An operator may stand on the deck so that the operator's feet are positioned on either side of the wheel, as shown in FIG. 2. At least one side of the deck may include a sensor, arranged immediately below one of the operator's feet. An example of a sensor adapted to respond to changes in pressure is shown in FIG. 3A and in an exploded view in FIG. 3B. In order to maintain an efficiency of the sensor in responding to change in pressure, a set of concave footpads may be added to the deck of the motorized skateboard to both allow the sensor to remain effective towards speed control of the motorized skateboard and to increase a responsiveness of the motorized skateboard to changes in direction as indicated by the operator. Various views of the set of footpads is shown in FIGS. 4-8, cross-sectional views of the set of footpads are depicted in FIGS. 9-10, and schematic diagrams of a first footpad with a first degree of curvature and a second footpad with a second degree of curvature are shown in FIGS. 14-15. One footpad of the set of footpads is shown coupled to a deck of a motorized skateboard in FIG. 11, sandwiched between the deck and a textured layer that provides traction for the operator's feet. The set of footpads may be secured to the deck by an adhesive, an example of which is shown in FIG. 12. An example of the textured layer that may be coupled to a top surface of the set of footpads is shown in FIG. 13. An exploded view of a wheel assembly, including a motor powering the motorized skateboard and an axle is illustrated in FIG. 16. The set of footpads may be formed from a flexible material and molded via an exemplary manufacturing method described in FIG. 17. An exploded view of a platform is shown in FIG. 18A and a cross-section of the platform is shown in FIG. 18B, the platform including a pressure transducer of a rider detection device with a footpad, such as a footpad of the set of footpads described with reference to FIGS. 4-11, 14-15, and 17, coupled to the platform. The platform may be included in a deck of a PT device. Alternative embodiments of a footpad are shown in FIGS. 19A-24B.

FIGS. 1-16, and 18A-24B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Turning now to FIGS. 1 and 2, an example of a personal transport (PT) device 100 is shown. The PT device 100 may be a self-stabilizing motorized skateboard including a deck 102 and a wheel assembly 104. A set of reference axes 106 are provided for comparison between views, indicating a y-axis, an x-axis, and a z-axis. In some example, the y-axis may be parallel with a vertical direction, the x-axis parallel with a horizontal axis, and the z-axis perpendicular to both the y-axis and the x-axis.

The deck 102 may be a structure for supporting an operator's feet, as shown in FIG. 2, and includes a frame 108, a first platform 110, and a second platform 112. The deck 102 may be formed from a hard, durable material, such as wood or metal or carbon fiber, etc. The deck 102 may have a rectangular outer geometry when viewed along the y-axis, with a length 114 of the PT device 100, defined along the z-axis, longer than a width 116, defined along the x-axis, and the width 116 greater than a thickness 118 of the PT device, the thickness 118 measured along the y-axis, depicted in FIG. 1. The first platform 110 and the second platform 112 may be of the same physical piece, or may be separate pieces and both platforms may be mounted to the frame 108. As shown in FIG. 2, the first platform 110 may be configured to support a first foot 103 of the operator and the second platform 112 may be configured to support a second foot 105 of the operator.

A direction of forward motion of the PT device 100 is indicated by arrow 120. As such, the first foot supported by the first platform 110 may be a lead foot of the operator and the first platform 110 is positioned at a front end 122 of the PT device 100. The second foot supported by the second platform 112 may be a rear foot of the operator and the second platform is positioned a rear end 124 of the PT device 100. The first platform 110 may be covered with a first textured layer 126 and the second platform 112 may be covered with a second textured layer 128 to provide traction between the operator's feet and upper surfaces of the platforms. The first and second textured layers 126 and 128 may be a non-slip material such as "grip tape", coupled directly to the upper surfaces of the first platform 110 and the second platform 112.

The wheel assembly 104 is arranged between the first platform 110 and the second platform 112 and protrudes above the deck 102 and below the deck 102, with respect to the y-axis through an opening 107 in the deck 102. The wheel assembly 104 includes a component that is in contact with a ground surface. The component may be a wheel 130, or a tire or a continuous track. The wheel 130 may be mounted to a motor assembly 136 which may mounted to the frame 108. The wheel assembly 104, including the motor assembly 136, is shown in exploded view 1600 in FIG. 16. Components in FIG. 16 that are similar to components of FIGS. 1 and 2 are similarly numbered. The wheel assembly 104 may include an axle 1601 extending through a central region of the wheel 130, along the x-axis and coupled to the frame 108 of the deck 102 of FIGS. 1 and 2 by axle mounts 1602 and fasteners 1604 in FIG. 16.

The motor assembly 136 includes a hub motor 1606 which may be positioned in an opening 1608 of the wheel 130. The axle 1601 may be inserted through a central aperture 1610 of the hub motor 1606 and the axle 1601, hub motor 1606 may be secured in place by mounting flanges 1612, hub adapters 1614, a plurality of bolts 1616, and various other fastening components. In one example, the hub motor 1606 may be a direct-drive transverse flux brushless motor providing torque output to power motion of the PT device 100 of FIGS. 1 and 2. In other examples, the hub motor 1606 may be any apparatus and/or motor suitable for driving rotation of the wheel 130 around the axle 1601. The hub motor 1606, wheel 130 and other coupling components of the wheel assembly 104 may be connected together as a subassembly and integrated and installed into the PT device 100. For example, a plurality of bolts, connecting mounts, and electrical connections (not shown) may be used to couple the wheel assembly 104 to the deck 102 of the PT device 100.

Returning to FIG. 2, the frame 108 of the deck 102 of the PT device 100 has a first longitudinal side 132, extending from the front end 122 to the rear end 124 of the PT device 100 along the z-axis as well as a second longitudinal side parallel with the first longitudinal side and on an opposite side of the PT device 100 (not shown in FIG. 2). The first longitudinal side 132 may include a side-skid pad 134 to provide a barrier between an outer surface of the first longitudinal side 132 and the ground surface if the PT device 100 is, for example, flipped on its side. The second longitudinal side may be similarly disposed with a side-skid pad. It will be appreciated that the side-skid pad 134 may vary in extension along a length of the first longitudinal side, e.g., along the z-axis, without departing from the scope of the present disclosure.

The PT device 100 may also include a first partial fender 138, coupled to the frame 108 and the first platform 110 and a second partial fender 140, coupled to the frame and the second platform 112. Each of the partial fenders may extend across the width, e.g., the width 116 of FIG. 1, of the deck 102. The first and second partial fenders 138, 140 may inhibit transfer of debris from the wheel 130 to the deck 102 when the wheel 130 is rotating. In other examples, the PT device 100 may have a full fender, entirely covering a portion of the wheel 130 protruding above the deck 102. The first and second partial fenders 138, 140 may be formed from a flexible or resilient material, such as plastic.

The PT device 100 is shown in FIG. 2 with a pitch axis A1, parallel with the x-axis, a roll axis A2, parallel with the z-axis, and a yaw axis A3, parallel with the y-axis. The pitch axis A1 may be an axis about which the wheel 130 is rotated by the motor assembly 136, passing through the axle (e.g., the axle 1601 of FIG. 16), the rotation driving motion of the PT device 100 along the z-axis. Tilting of the deck 102 relative to the pitch axis A1, as adjusted by the operator, enables speed control of the PT device. For example, when the deck 102 is parallel with the x-z plane, e.g., when the operator stands on the first and second platforms 110, 112 with equal weight distribution between the first foot 103 and the second foot 105 and between a forefoot and a heel of the first foot 103, the motor assembly 136 of the PT device 100 may be activated. Increasing weight on the first foot 103, which may tilt the front end 122 of the PT device 100 downwards, with respect to the y-axis, indicates forward movement of the PT device 100 is desired. When in motion, decreasing weight on the first foot 103 may decrease the forward speed of the PT device 100. Tilting the rear end 124 downwards, with respect to the y-axis may also result in halting of the PT device 100.

The operator may voluntarily tilt the deck 102 of the PT device 100 about the roll axis A2 and the yaw axis A3 to steer, e.g., control a direction of, the PT device 100 as the PT device is travelling as long as the operator's weight is distributed across the forefoot and heel of the operator's first foot 103. The tilting of the deck 102 may be detected by various sensors (not shown) arranged in the deck 102, e.g., coupled to a bottom surface of the deck 102 and configured to measure orientation information of the deck 102 (e.g., a gyroscope), movement of the PT device 100, rotation of the wheel 130, etc. The PT device 100 may also include various electrical components such as a power supply, a motor controller, a rider detection device, a power switch, a charge plug, illumination assemblies, etc. (not shown).

To provide information to the motor controller to control movement of the PT device 100 based on adjustment of the operator's weight on the first foot 103, a rider detection device may be disposed in the first platform 110 of the PT device 100. An example of a rider detection device 302 is shown in a perspective view 300 in FIG. 3A and in an exploded view 350 in FIG. 3B. The rider detection device 302 may be a flat, rectangular panel coupled to an electrical connector 304 to electrically couple the rider detection device 302 to a motor controller configured with a microcontroller that receives information from sensor of a PT device and sends instructions to actuators of the PT device, such as the wheel 130 of FIGS. 1, 2, and 16.

The rider detection device 302 includes a deck portion 306, which may be a rigid frame for the rider detection device 302, and a pressure transducer 308 sandwiched between the deck portion 306, the deck portion 306 arranged below the pressure transducer 308, and a slip-resistant layer 310 arranged above the pressure transducer 308, with respect to the y-axis. The exploded view 350 of FIG. 3B shows that the pressure transducer 308 is formed from several components.

The pressure transducer 308 includes an upper force-sensitive resistor (FSR) layer 312 and a lower conductive layer 314 separated by a spacer layer 316. The FSR layer 312 may include any suitable layer having an electrical resistance that changes predictably in response to an applied force (e.g., a pressure exerted by an operator's foot placed on top of the rider detection device 302), such as a conductive polymer ink applied to a PET film substrate. The FSR layer 312 may be partially conductive and/or variably conductive with a variable resistance. The conductive layer 314 may include any suitable conductive material, such as a partial electrical circuit.

When the FSR layer 312 is displaced toward conductive layer 314 due to pressure applied by an operator's foot, the FSR layer 312 may contact the conductive layer 314, completing the electrical circuit and transmitting a signal indicating that the operator is present. An amount of current flow induced by contact between the layers may be proportional to an amount of applied pressure, thus providing information about a desired speed of the PT device, for example. The conductive layer 314 is shown in FIG. 3B to include a portion that passes through an aperture 318 in the deck portion 306 to connect with the electrical connector 304.

The spacer layer 316 may be formed from any suitable non-conductive, e.g., dielectric, material that maintains the FSR layer 312 and the conductive layer 314 separated without applied pressure. In some examples, as shown in FIG. 3B, the spacer layer 316 includes a first portion 316*a* and a second portion 316*b* that may between placed adjacent to one another between the FSR layer 312 and the conductive layer 314. Dimensions and shapes of the first portion 316*a* and second portion 316*a* of the spacer layer 316 may vary from the examples shown in FIG. 3B. For example, the spacer layer 316 may be disposed along a periphery of the FSR layer 312 and conductive layer 314, thereby leaving central or middle portions of each layer free to interact.

In some examples, the pressure transducer 308 may be divided into a first zone 320 and a second zone 322, as shown in FIG. 3A. The first zone 320 may correspond to a positioning of a first portion of the operator's lead foot, such as the forefoot, and the second zone 322 may correspond to a positioning of a second portion of the operator's lead foot, such as the heel. Detection of pressure in one zone but not the other may indicate a command to stop movement of the PT device. For example, when the operator raises the heel of the operator's lead foot off the rider detection device 302, the microcontroller may instruct a hub motor of the PT device to decelerate and come to a full stop in response.

The slip-resistant layer 310 may be a layer positioned between the pressure transducer 308 and the operator's foot that provides traction for the operator's foot. For example, the slip-resistant layer 310 may include a non-skid material, grip tape, a textured layer, or any combination of such elements. The slip-resistant layer 310 may be similar in size or larger than the pressure transducer 308 such that the slip-resistant layer 310 also acts as a barrier between the pressure transducer and external objects, debris, liquids, etc.

While FIG. 3B shows a pressure transducer with a single conductive layer and FSR layer, other examples may include variations in quantities of each layer. For example, the pressure transducer may include two or more FSR layers and a suitable amount of spacer layers and conductive layers. Any suitable combination of layers may be utilized.

Displacement of the layers of the rider detection device 302 that allows a sensed force or pressure to be converted into an electrical signal may be relatively small. For example, deflection or displacement of the pressure transducer 308 may be in a range of 0.005 to 0.020 inches. In other words, a separation distance between the FSR layer 312 and the conductive layer 314 may be reduced by 0.005-0.020 inches when the operator applies an activation force or pressure to the rider detection device 302. However, in other examples the displacement distance range may vary. In some examples, the rider detection device 302 may have a threshold, baseline amount of pressure to be placed upon the rider detection device 302 in order to activate the motor assembly of the PT device. Increasing a number of material layers between the operator's foot and the rider detection device 302 may desensitize the pressure transducer 308 to changes in pressure applied by the operator's foot.

For example, it may be desirable to add a concave curvature to a deck of the PT device. An increased thickness of the deck around a perimeter of the deck may impart the operator with greater control in maneuvering the PT device, increasing a responsive of the PT device to desired changes in direction as indicated by weight transfer through the operator's foot placed over the rider detection device 302. However, forming the deck of the PT device with concave curvature may inhibit activation of the pressure transducer 308 by decreasing contact between the operator's foot and the rider detection device 302. As an alternative, a footpad may be used that maintains sensitivity of the rider detection device 302 to changes in applied pressure while providing the operator with enhanced maneuverability of the PT device.

Figure 4:
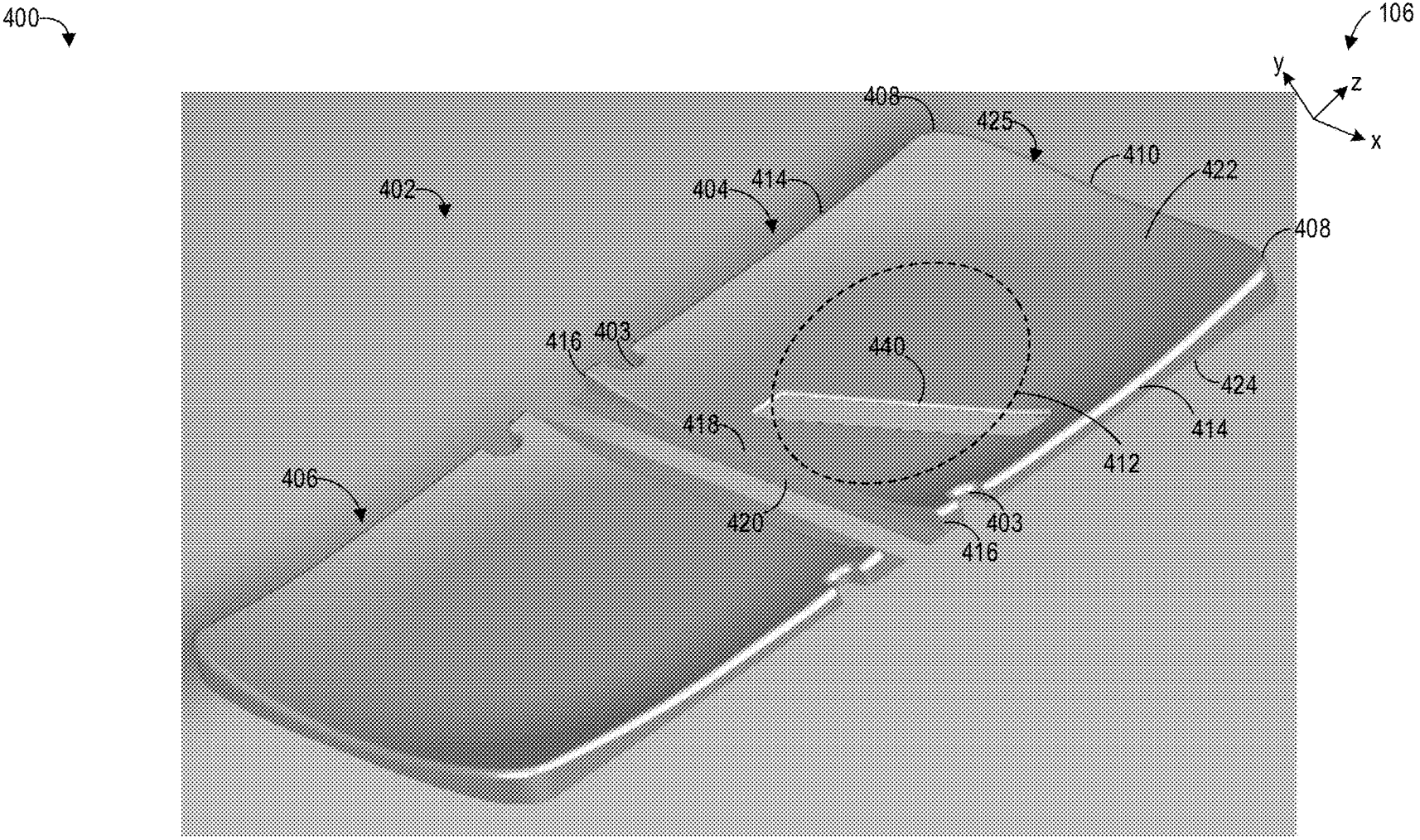
FIG. 4 shows an example of a set of footpads from a first perspective view that may be applied to a surface of the personal transport device of FIG. 1.
Figure 5:
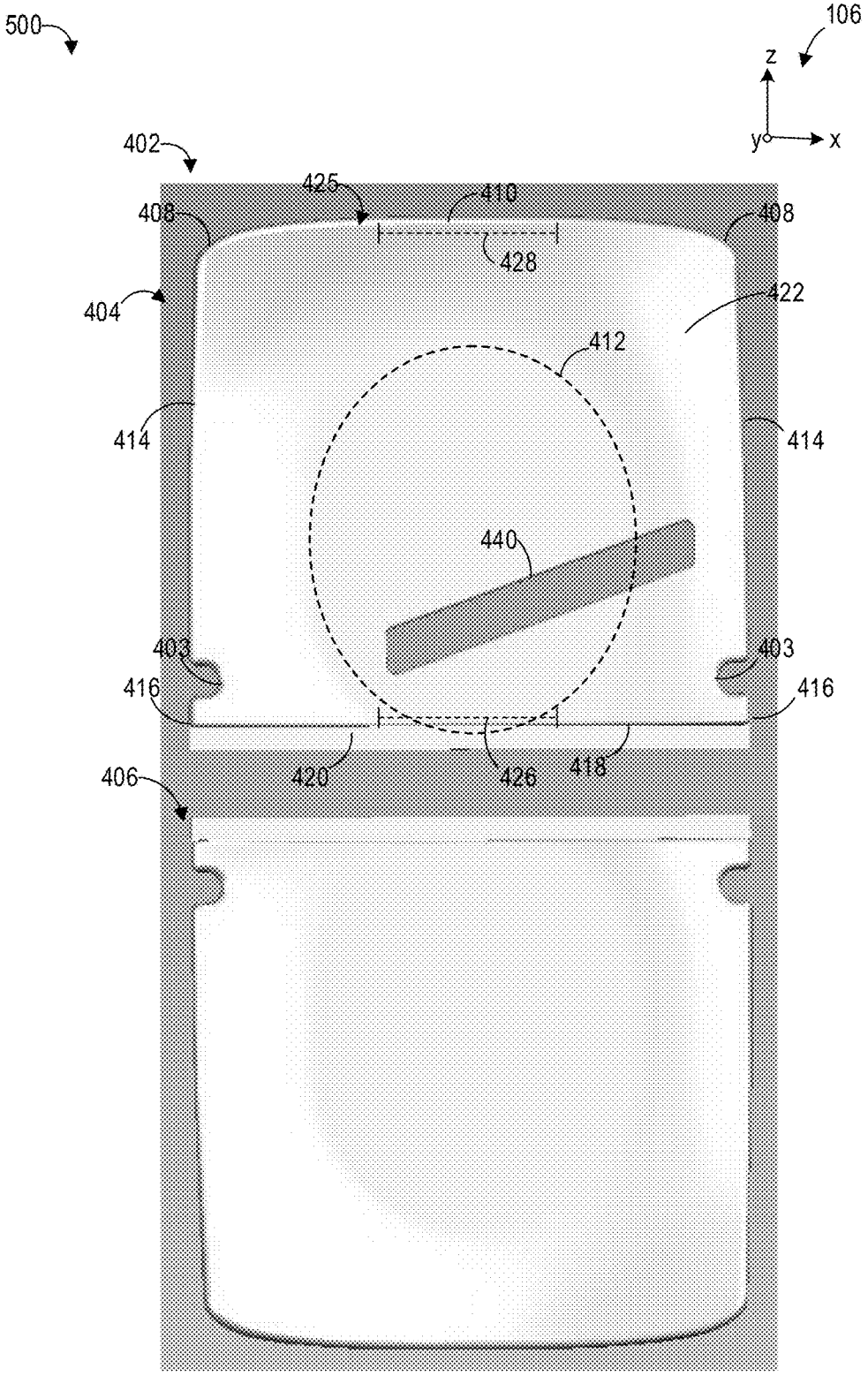
FIG. 5 shows the set of footpads from a birds-eye view.
Figure 6:
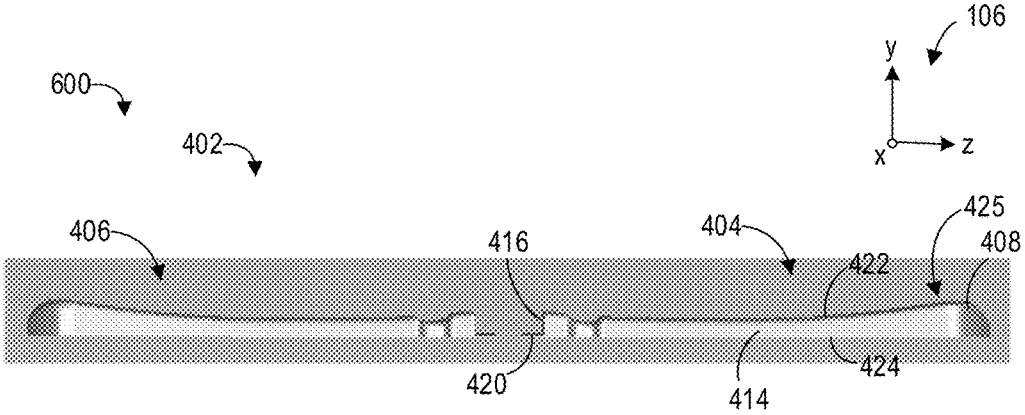
FIG. 6 shows the set of footpads from a profile view.
Figure 7:
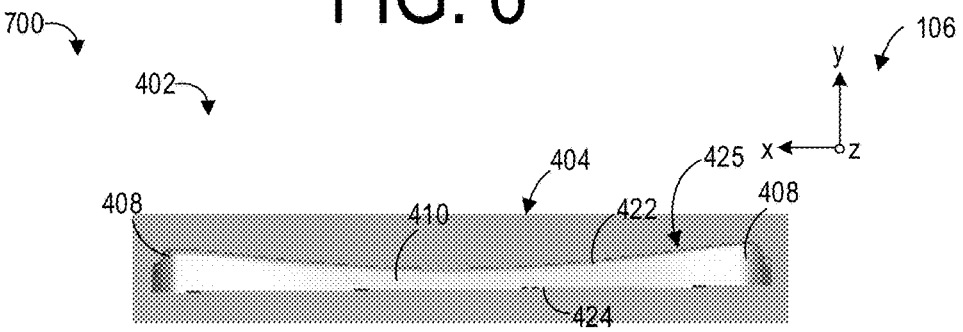
FIG. 7 shows the set of footpads from a front view.
Figure 8:
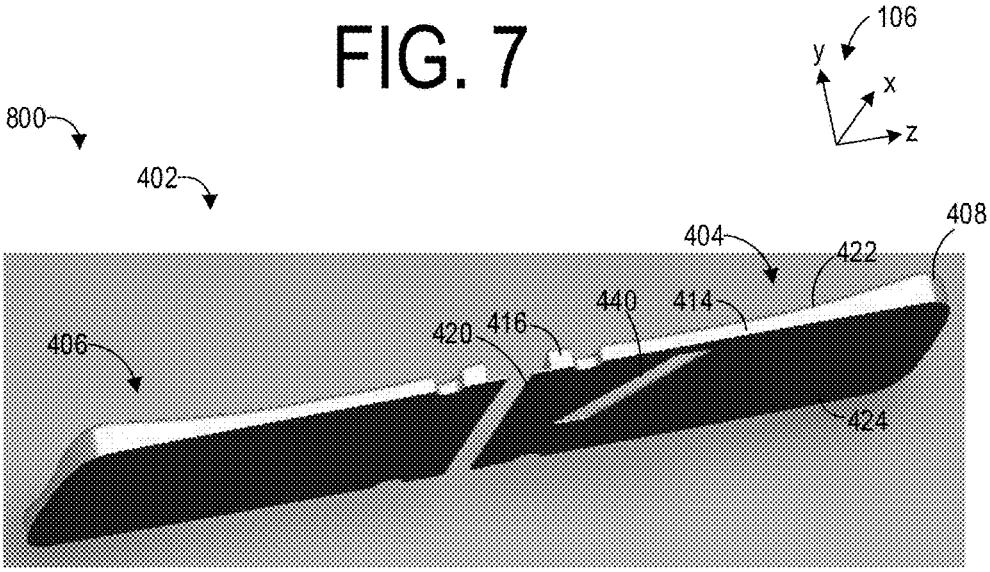
FIG. 8 shows the set of footpads from a second perspective view.

An example of a set of footpads 402 is shown in FIG. 4 from a first perspective view 400, in a birds-eye view 500 in FIG. 5, a profile view 600 in FIG. 6, a front view 700 in FIG. 7, and a second perspective view 800 in FIG. 8. A first cross-section 900 of the set of footpads 402 is depicted in FIG. 9 and a second cross-section 1000 is illustrated in FIG. 10. As such, FIGS. 4-10 are described collectively.

The set of footpads 402 includes a first pad 404 and a second pad 406, each pad configured to couple to opposite ends of a PT device deck. For example, the first pad 404 may be coupled to an upper surface of the first platform 110 of FIGS. 1 and 2, and the second pad 406 may be coupled to an upper surface of the second platform 112 of FIGS. 1 and 2. The set of footpads 402 may be arranged sandwiched between the upper surfaces of the first platform and the second platform of the PT device deck and a layer of a textured material or non-slip layer, such as the first and second textured layers 126, 128 of FIGS. 1 and 2 and the slip-resistant layer 310 of FIGS. 3A-3B. As such, contact between an operator's feet and the textured, non-slip layer is maintained.

The first pad 404 and the second pad 406 may each have generally rectangular geometries, when viewed along the y-axis as shown in FIG. 5, two curved corners and at least one curved edge. For example, the first pad 404 may be arranged so that a first set of corners 408 that are rounded and a curved edge 410 are oriented towards a front end of the deck, e.g., the front end 122 of FIGS. 1 and 2. The curvature of the first set of corners 408 and the curved edge 410 may match a geometry of the first platform of the deck. The second pad 406 may be similarly shaped to match a geometry of the second platform of the deck. Dimensions of the first pad 404, such as a width measured along the x-axis and a length measured along the z-axis may be similar to or smaller than dimensions of the first platform and dimensions of the second pad 406 may be similar to or smaller than dimensions of the second platform.

In the following paragraphs, details of the first pad 404 will be described and not the second pad 406 for brevity. However, aspects of the first pad 404 discussed below may be similarly applied to the second pad 406. The curved edge 410 of the first pad 404 may be curved along the x-z plane, as illustrated in FIG. 5, curving outwards and away from a central region 412 of the first pad 404. Side edges 414 of the first pad 404 may be straight or slightly curved, each side edge extending from one corner of the first set of corners 408 to a corner of a second set of corners 416. The side edges 414 may include notches 403 proximate to the second set of corners 416 to allow access to screws disposed in the first platform.

The second set of corners 416 may form perpendicular corners with straight sides. An inner edge 418 of the first pad may be straight and parallel with the x-axis, extending between the second set of corners 416. The first pad may include a flap 420 extending along the inner edge 418, also between the second set of corners 416. The flap 420 may extend along the z-axis away from the inner edge 418 and have a uniform length, the length measured along the z-axis. The flap 420 may be thinner than the first pad 404 between the inner edge 418 and the curved edge 410, the thickness defined along the y-axis.

An upper surface 422 of the first pad 404 may be curved in a concave manner, e.g., curving downwards relative to the y-axis towards a bottom surface 424 of the first pad 404, as depicted in FIGS. 4, 6-10. The bottom surface 424 may be straight and coplanar with the x-z plane. Due to the concave geometry of the upper surface 422, the thickness of the first pad 404 (with the exception of the flap 420), may be thickest at an outer perimeter 425, shown in FIGS. 4 and 5, of the first pad 404, the outer perimeter 425 including the curved edge 410 and the side edges 414. Furthermore, the thickness of the first pad 404 may be greatest at the first set of corners 408, as shown in FIGS. 6 and 7 and decrease between the first set of corners 408 along the curved edge 410 and along the side edges 414 between the first set of corners 408 and the second set of corners 416.

With the exception of the flap 420, the central region 412 of the first pad 404 may be a thinnest portion of the first pad 404. The central region 412 may be biased towards the inner edge 418 so that a central portion of the inner edge 418, indicated by a dashed line 426 in FIG. 5, is thinner than a central portion of the curved edge 410, also indicated by a dashed line 428 in FIG. 5. Along the outer perimeter 425, the upper surface 422 may curve continuously from the outer perimeter 425 to the central region 412, the thickness of the first pad 404 gradually decreasing from the outer perimeter 425 to the central region 412, as shown in FIGS. 9 and 10.

The first cross-section 900 of the first pad 404 of FIG. 9 cuts the first pad 404 along the y-z plane and the second cross-section 1000 of FIG. 10 cuts the first pad 404 along the x-y-plane. A thickness 902 of the central region 412 of the first pad 404 may be a portion of a thickness 904 of the first pad 404 at the first set of corners 408, such as 20% or 30%, as shown in FIG. 9. In some examples, the thickness 902 of the central region 412 may be within a range of 20-60% of the thickness 904 of the first pad 404 at the first set of corners 408.

The central region 412 of the first pad 404 may be elliptical in shape, when viewed from above, as shown in FIG. 5. A surface area of the central region 412 may form a portion of an overall surface area of the first pad 404, such as 50%. In other examples, the central region 412 may form a portion of the overall surface area of the first pad 404 between 30%-70%. The first pad 404 may also include a cut-out 440, as shown in FIGS. 4, 5, 8 and 9, extending entirely through the thickness of the first pad 404, as shown in FIG. 8, to allow a logo disposed on the upper surface of the first platform to be visible through the first pad 404.

FIGS. 6-10 shows that the bottom surface 424 of the first pad 404 is planar and not curved, allowing the bottom surface 424 to be in face-sharing contact with the upper surface of the first platform of the PT device across the entire bottom surface 424. By configuring the first pad 404 with the central region 412 thinner than the outer perimeter 425 of the first pad 404, the thinnest region of the first pad 404 may be positioned over a pressure transducer of the PT device, disposed in the first platform and directly below a central portion of the operator's lead foot. The reduced thickness of the first pad 404 at the central region 412 allows adjustments in weight transfer, through weight shifting on the lead foot, to transmit through the first pad 404 to the pressure transducer.

The thickness 902 of the central region 412 may be constrained to achieve a high degree of responsiveness of the pressure transducer to pressure changes. The thickness 904 of the first set of corners 408 and of the outer perimeter 425 of the first pad 404 may be more variable than the central region 412, allowing the concavity of the first pad 404, and thereby a receptiveness of the PT device to operator-induced steering, to be modified. For example, a first set of footpads 1400 is shown in FIG. 14 and a second set of footpads 1500 is shown in FIG. 15. The first set of footpads 1400 may have a different thickness and concavity than the second set of footpads 1500, as indicated by contours.

The first set of footpads 1400 of FIG. 14 has a first pad 1401 and a second pad 1403. The first pad 1401 may be configured to be applied to a portion of a deck of a PT device adapted with a pressure transducer. The first pad 1401 may have a first contour 1402, indicating that an upper surface 1405 of the first set of footpads slopes upwards from the first contour 1402 to an outer perimeter 1404, including a curved edge 1406 and side edges 1408, of the first set of footpads 1400. An increase in thickness, defined along the y-axis, from the first contour 1402 to the outer perimeter 1404 may be, as an example, 0.2 inches. Toes of an operator's lead foot may be positioned directly above and in contact with a region of the upper surface 1405 of the first pad 1401 between the first contour 1402 and one of the side edges 1408. A heel of the operator's lead foot may be positioned directly above and in contact with a region the upper surface 1405 of the first pad between the first contour 1402 and the other of the side edges 1408. By shifting the operator's weight towards the toes of the lead foot or towards the heel, the deck of the PT device may be tilted about a roll axis 1410 of the PT device. A concavity of the first set of footpads 1400 allows a smaller weight shift to effect an equal amount of tilting of the deck about the rolls axis 1410 compared to a set of footpads with a planar, e.g., not curved, upper surface.

The second set of footpads 1500 of FIG. 15 has a first pad 1501 and a second pad 1503 which may be used similarly as the first set of footpads 1400. The first pad 1501 may have a first contour 1502, indicating that an upper surface 1505 of the second set of footpads 1500 slopes upwards from the first contour 1502 to second contour 1504. An increase in thickness, defined along the y-axis, from the first contour 1502 to the second contour 1504 may be, in one example, similar to the increase in thickness in the first pad 1401 of the first set of footpads 1400 of 0.2 inches. An increase in thickness from the second contour 1504 to an outer perimeter 1506, including a curved edge 1508 and side edges 1510, may also be 0.2 inches. The increase in thickness from the first contour 1502 to the outer perimeter 1506 may therefore be 0.4 inches. The outer perimeter 1506 of the first pad 1501 of the second set of footpads 1500 may be twice as thick as the outer perimeter 1404 of the first pad 1401 of the first set of footpads 1400. As such the second set of footpads 1500 may have a greater degree of concavity than the first set of footpads 1400. The increased concave curvature of the second set of footpads 1500 may allow smaller weight shifts to effect equal tilting of the deck of the PT device about a roll axis 1512 compared to the first set of footpads 1400.

Figure 11:
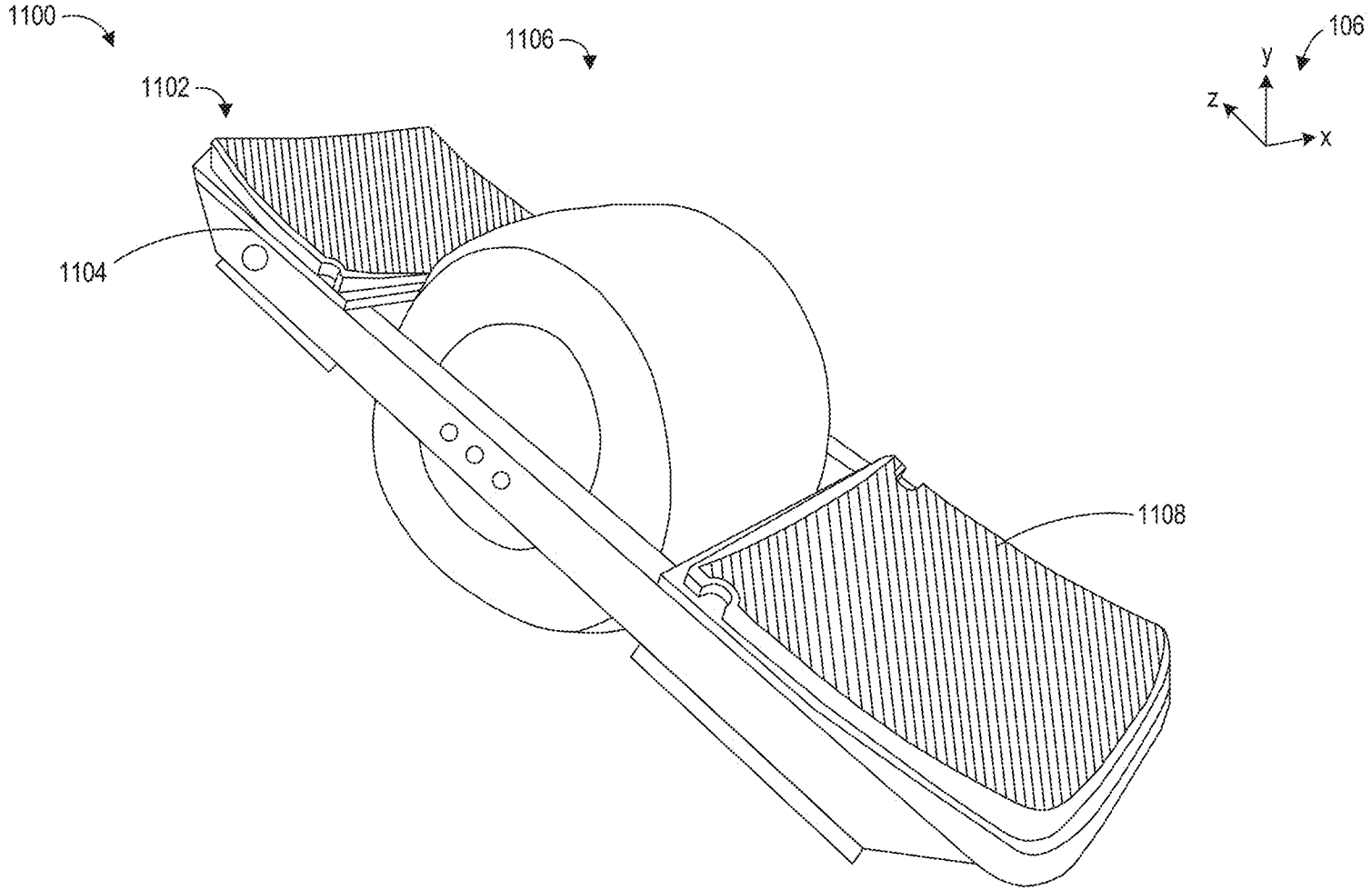
FIG. 11 shows a positioning of a set of footpads on a personal transport device.
Figure 12:
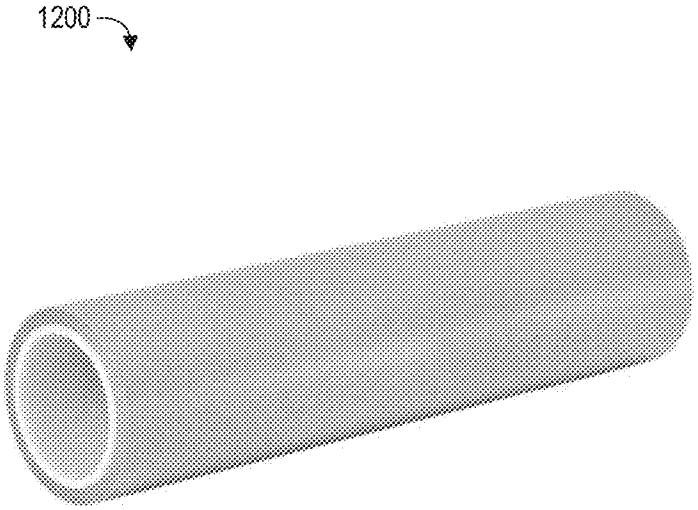
FIG. 12 shows an example of an adhesive that may be used to couple a set of footpads to a personal transport device.

As shown in a perspective view 1100 in FIG. 11, a set of concave footpads 1102 may be applied to a deck 1104 of a PT device 1106. The set of concave footpads 1102 may be positioned over an upper surface of the deck 1104 where an operator's feet may be placed when standing on the deck 1104. The set of concave footpads 1102 may be adhered to the upper surface of the deck 1104 by a layer of adhesive transfer tape. An example of a roll of adhesive transfer tape 1200 is shown in FIG. 12. The roll of adhesive transfer tape 1200 may have adhesive on both an upper surface and a bottom surface of the tape and may be cut to a desired shape to accommodate a geometry of the set of concave footpads 1102 of FIG. 11.

Returning to FIG. 11, a layer of a non-slip material, such as grip tape 1108, may be applied to an upper surface of the set of concave footpads 1102, between the set of concave footpads 1102 and the operator's feet. The grip tape 1108 provides a textured layer to increase traction between the soles of the operator's shoes and the set of concave footpads 1102. An example of a roll of grip tape 1300 is shown in FIG. 13. The roll of grip tape 1300 may have a first surface 1302 that is textured and a second surface 1304, opposite of the first surface 1302 that has a layer of an adhesive.

A layering of a concave footpad, similar to the set of footpads shown in FIGS. 4-11 and 14-15, on a deck of a PT device, is shown in an exploded view 1800 in FIG. 18. The exploded view 1800 includes the rider detection device 302 of FIGS. 3A-3B and further includes a concave footpad 1802, positioned above, with respect to the y-axis, the rider detection device 302. More specifically, a layer of adhesive 1804, which may be a layer formed from the roll of adhesive transfer tape 1200 of FIG. 12, may be positioned between an upper face 1806 of the FSR layer 314 and a lower, planar surface 1808 of the concave footpad 1802. The lower surface 1808 of the footpad 1802 may be coupled to the upper face 1806 of the FSR layer 314 by the layer of adhesive 1804. An upper surface 1810 of the concave footpad 1802 is in face-sharing contact with a lower surface 1812 of a layer of grip tape 1814. The lower surface 1812 of the layer of grip tape 1814 may have an adhesive coating to adhere to the upper surface 1810 of the concave footpad 1802 and an upper surface 1816 of the layer of grip tape 1814 may be textured and configured to directly contact a foot of an operator. Thus, pressure applied by the operator's foot is transmitted through the layers shown in FIG. 18, allowing the pressure transducer 308 to maintain sensitivity to variations in an applied downwards force.

A coupling of layers shown in FIG. 18A is shown stacked and in face-sharing contact in a cross-section 1850 depicted in FIG. 18B, taken along line A-A', along the y-x plane, shown in FIG. 18A. The cross-section 1850 illustrates direct coupling of adjacent layers to one another, stacked along the y-axis. A difference between the curvatures of the lower surface 1808 of the footpad 1802 and the upper surface 1810 is shown. All layers below the footpad 1802 are planar while the layer of grip tape 1814 is curved similarly to the upper surface 1812 of the footpad 1802 due to the coupling of the layer of grip tape 1814 to the footpad 1802.

A combination of one or more of a degree of concavity of an upper surface of a footpad, a planar bottom surface of the footpad, and a stiffness of the footpad (along with the corresponding geometry of the sensor, surrounding board, etc.) may together allow the footpad to be coupled to a pressure transducer of a PT device while maintaining a sensitivity of the pressure transducer across an entire surface area of the pressure transducer. The planarity of the bottom surface of the footpad enables directly coupling of the footpad across the entire surface area of a planar upper face of the pressure transducer. Application of a downwards mechanical force to any point along the surface area of the pressure transducer may be transmitted through the footpad to generate a current at the footpad, at a location corresponding to a location of the force.

However, imperfections in both the upper face of the pressure transducer and the bottom surface of the footpad may result in non-continuous contact across the surfaces of the pressure transducer and the footpad. For example, tiny bumps or udulations in the upper face of the pressure transducer may create points of contact (and non-contact) between the footpad and the pressure transducer surrounding by areas where the two components are spaced apart. A decrease in sensitivity due to the imperfections in the surfaces may be countered by providing the footpad with an amount of stiffness that balances sufficient rigidity of the footpad to support an operator's weight without permanent deformation with enough flexible to fill in areas around the tiny bumps in the upper face of the pressure transducer. Thus adjusting physical properties of the footpad may enable more continuous contact between the pressure transducer and the footpad.

For example, the footpad may be formed with a Shore A hardness of 90. By configuring the footpad with dimensions that at least cover the entire surface area of the pressure transducer and a target amount of concavity, such as the degree of concavity shown by the first set of footpads 1400 of FIG. 14, the footpad may be effectively coupled to the pressure transducer with a similar responsiveness to pressure changes as if the footpad were not arranged between the operator's foot and the pressure transducer. Varying the degree of concavity, e.g., to achieve a different reactivity to steering, may be accompanied by an adjustment to the stiffness of the footpad. As an example, imparting the footpad with more concavity may be balanced by a footpad with a lower durometer measurement. In another example, varying a thickness of a central region of the footpad, defined as a thinnest portion of the footpad, may include adjusting the stiffness of the footpad to maintain a sensitivity of the pressure transducer through the footpad. For example, a footpad with a thicker central region may be less stiff than a footpad with a thinner central region.

It will be appreciated that the examples of a set of footpads shown in FIGS. 4-11, 14-15, and 18 are non-limiting examples and variations to dimensions, geometry, thickness, placement on a deck of a PT device, notches, cut-outs, and number of footpads per PT device have been contemplated. Furthermore, while the example of a PT device shown in FIGS. 2, 3, and 11 depict one type of PT device with a central wheel protruding through a deck, the set of footpads may be applied to many different types of PT devices, such as non-motorized skateboards, electric skateboards, snowboards, and various other types of devices configured to receive an operator's feet. In addition, relative thickness of the various elements coupled to the deck of the PT device, such as the layers shown in FIGS. 18A-18B, and including the deck, may vary from the relative thicknesses shown.

Dimensions and a degree of concavity of a footpad or a set of footpads, e.g., the footpad of set of footpads 402 of FIGS. 4-10, 1102 of FIG. 11, 1400 of FIG. 14, 1500 of FIG. 15, and 1802 of FIG. 18, for a PT device adapted with a pressure transducer in a deck of the PT device may be readily adjusted during a process for forming the se of footpads. The set of footpads may be formed from a flexible material, such as a rubber, that provides the set of footpads with a suitable amount of rigidity to resist permanent deformation and to transmit changes in pressure through a thickness of the set of footpads, as moderated by an operator's feet, balanced with an amount of cushioning to provide a comfortable positioning of the operator's feet on the set of footpads. For example, the set of footpads may be formed from polyurethane with a Shore A hardness of 90. In other examples, the set of footpads may be formed from a differ materials, such as agglomerated cork, foam, or mycelium. An example of a routine 1700 for forming the set of footpads is shown in FIG. 17. The routine 1700 may include a kit providing materials and instruments utilized during the routine which may be carried out by an operator.

At 1702, the routine includes forming a mold for the set of footpads with a desired geometry for the set of footpads. The mold may be cut from wax, or formed from a rigid material such as plaster, concrete, or wood and sealed to impart the mold with smooth non-porous surfaces. Rubber is added to the mold at 1704. Adding the rubber may include mixing reagents to form a liquid, pourable rubber at 1706. For example, a volume of a polyurethane prepolymer, such as toluene diisocyanate, may be mixed with a volume of a polymerization agent, such as a blend of polyol and aromatic amines, in a predetermined ratio to achieve a desired hardness of the rubber. A tint or dye may be added to the liquid rubber at 1708 to impart the rubber with a desired color. At 1710, the routine may include pouring the liquid rubber into the mold to fill cavities of the mold.

At 1712, the method includes allowing a predetermined period of time to elapse to enable curing of the liquid rubber. During curing, the reagents may interact and induce polymerization and causing a phase change of the rubber, from liquid to solid. The cured, solid set of footpads are removed from the mold at 1714. The finished set of footpads may then be adhered to a deck of the PT device with transfer tape, such as the roll of transfer tape 1200 shown in FIG. 12, and topped with grip tape, such as the roll of grip tape 1300 shown in FIG. 13.

In some examples, the kit may also include a tool or instruments for preparing the deck of the PT device to receive the set of footpads. For examples, the deck may have a layer of grip tape directly coupled to an upper surface of the deck. It may be desirable to remove the grip tape prior to application of the set of foot pads.

In this way, a set of footpads may be added to a deck of a personal transport device, such as a motorized skateboard, to provide a concave curvature without adversely affecting efficiency of a pressure transducer disposed in the deck. The concave curvature may increase a responsiveness of the personal transport device to rocking motions across an operator's feet, when the operator is standing on the set of footpads, to effect changes in direction of the device when the device is in motion. The pressure transducer in the deck detects changes in pressure, transmitted through the operator's feet, across a surface of the pressure transducer and adjusts a speed of the personal transport device in response. By configuring each pad of the set of footpads with a central region that is thinner than a peripheral region of each pad and forming the set of footpads from a material with a specific balance of rigidity and cushioning, sensitivity of the pressure transducer to changes in pressure is maintained in spite of the distancing of an operator's foot from the pressure transducer by the thickness of the central region of the pad. The set of footpads are manufactured via a low cost method that allows dimensions and a degree of curvature of the footpads to be readily adjusted thereby enabling modification of the set of footpads according to operator's preferences and configuration of the personal transport device.

A technical effect of implementing the set of footpads in a personal transport device is that a steering efficiency of the device is increased while a sensitivity of the pressure transducer to changes in applied force is maintained.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A footpad, comprising:

a concave upper face and a planar lower face, the lower face opposite of the upper face and configured to be coupled to a pressure sensing device;

a central region of the footpad forming a planar section of the lower face configured to be positioned directly above the pressure sensing device;

a curved outer edge; and a set of side edges perpendicular to the outer edge, the outer edge and set of side edges forming an outer perimeter of the footpad and wherein the outer perimeter is thicker than the central region of the footpad, wherein an inner edge of the footpad, arranged opposite of the outer edge, is straight and thinner than the outer perimeter, and wherein a flap coupled to the inner edge that is thinner than the inner edge extends away from the inner edge and along the inner edge, from one of the set of side edges to the other of the set of side edges.

2. The footpad of claim 1, wherein a region of the upper face of the footpad between the outer perimeter and the central region curves continuously.

3. The footpad of claim 1, wherein the central region has an elliptical peripheral shape.

4. The footpad of claim 1, wherein a first set of corners arranged at intersections of the curved outer edge and the set of side edges are curved and wherein the footpad is thickest at the first set of corners.

5. The footpad of claim 4, wherein a second set of corners arranged at intersections of the inner edge and the set of side edges are straight and wherein the set of side edges include notches arranged proximate to the second set of corners.

6. The footpad of claim 1, wherein the footpad is formed from one of polyurethane, agglomerated cork, foam, and mycelium, with a Shore A hardness of 90.

7. A personal transport device, comprising:

a first concave pad coupled to a first platform of a deck of the personal transport device, the first pad and first platform arranged at a front end of the personal transport device;

a second concave pad coupled to a second platform of the deck, the second pad and second platform arranged at a rear end, opposite of the front end, of the personal transport device, the first pad coplanar with the second footpad and spaced apart from the second pad; and a pressure transducer in the first platform positioned under and in contact with the first pad, wherein the first pad is attached to an upper surface of the first platform and the second pad is attached to an upper surface of the second platform by a layer of transfer tape.

8. The personal transport device of claim 7, wherein an outer geometry of the first pad is similar to an outer geometry of the first platform and an outer geometry of the second pad is similar to an outer geometry of the second platform.

9. The personal transport device of claim 7, wherein the first pad and the second pad have concave upper surfaces and planar lower surfaces configured to couple to planar upper surfaces of the first platform and the second platform.

10. The personal transport device of claim 7, wherein the first pad and the second pad are formed from a more flexible material than the first platform and the second platform.

11. The personal transport device of claim 7, wherein the first pad is identical in shape to the second pad.

12. The personal transport device of claim 7, wherein a layer of a textured material is adhered to upper surfaces of the first pad and the second pad.

13. The personal transport device of claim 7, wherein a central region of the first pad is thinner than an outer periphery of the first pad, and wherein the central region is positioned directly over the pressure transducer.

* * * * *